US010588798B2

(12) United States Patent
Latham

(10) Patent No.: US 10,588,798 B2
(45) Date of Patent: Mar. 17, 2020

(54) METHOD, APPARATUS, AND SYSTEM FOR IMPLEMENTING SEAT LIFTING

(71) Applicant: Stephen Latham, Denver, CO (US)

(72) Inventor: Stephen Latham, Denver, CO (US)

( * ) Notice: Subject to any disclaimer, the term of this patent is extended or adjusted under 35 U.S.C. 154(b) by 0 days.

(21) Appl. No.: 15/454,138

(22) Filed: Mar. 9, 2017

(65) Prior Publication Data

US 2017/0258652 A1 Sep. 14, 2017

Related U.S. Application Data

(60) Provisional application No. 62/307,134, filed on Mar. 11, 2016.

(51) Int. Cl.
*A61G 5/14* (2006.01)
*A47C 1/022* (2006.01)
(Continued)

(52) U.S. Cl.
CPC ..... *A61G 5/14* (2013.01); *A47C 1/022* (2013.01); *A47C 3/02* (2013.01); *A47C 7/506* (2013.01); *A47C 7/62* (2013.01); *A47C 11/00* (2013.01); *A47K 11/04* (2013.01); *A47K 13/10* (2013.01); *A47K 17/028* (2013.01)

(58) Field of Classification Search
CPC ..... A61G 5/14; A61G 5/1002; A61G 7/1007; A61G 2200/34; A61G 2200/36;
(Continued)

(56) References Cited

U.S. PATENT DOCUMENTS 948,029 A * 2/1910 Trimble ..... A47C 1/035 297/87
3,261,031 A * 7/1966 Gates ..... A61G 5/006 297/DIG. 10
(Continued)

FOREIGN PATENT DOCUMENTS

FR 2834879 A1 * 7/2003 ..... A47K 13/24
JP 2006-122069 A 5/2006
JP 2011-167297 A 9/2011
JP 2013-111387 A 6/2013
(Continued)

OTHER PUBLICATIONS

Machine translation of foreign reference FR 2834879, obtained from http://translationportal.epo.org/emtp/translate/?ACTION=description-retrieval&COUNTRY=FR&ENGINE=google&FORMAT=docdb&KIND=A1&LOCALE=en_EP&NUMBER=2834879&OPS=ops.epo.org/3.2&SRCLANG=fr&TRGLANG=en (last accessed on Sep. 10, 2018) (Year: 2018).*
(Continued)

*Primary Examiner* — Theodore V Adamos
(74) *Attorney, Agent, or Firm* — Adsero IP

(57) ABSTRACT

Novel tools and techniques might provide for implementing seat lifting. In various embodiments, a seat lifter might include one or more first pistons, one or more second pistons, and a seat portion. The one or more first pistons, when actuated (e.g., in response to user input), might cause a rear portion of the seat portion to lift relative to a front portion of the seat portion, the rear portion of the seat portion being lifted by a first height above a seat to which the seat lifter is affixed. The one or more second pistons, when actuated, might cause the front portion of the seat portion to lift by a second height above the seat, the second height being less than the first height. In some instances, the first pistons and the second pistons might be actuated serially (in either order), or might be actuated concurrently.

25 Claims, 15 Drawing Sheets

(51) Int. Cl.

| | |
|---|---|
| ***A47C 3/02*** | (2006.01) |
| ***A47C 7/50*** | (2006.01) |
| ***A47C 7/62*** | (2006.01) |
| ***A47C 11/00*** | (2006.01) |
| ***A47K 11/04*** | (2006.01) |
| ***A47K 17/02*** | (2006.01) |
| ***A47K 13/10*** | (2006.01) |

(58) Field of Classification Search

CPC ..... A47K 13/10; A47K 11/04; A47K 17/028; A47C 11/00; A47C 7/62; A47C 7/506; A47C 3/02; A47C 1/022; A47C 1/034; A47C 1/037; A47C 20/021; A47C 7/50; A47C 1/035

See application file for complete search history.

(56) References Cited

U.S. PATENT DOCUMENTS

| | | | | | |
|---|---|---|---|---|---|
| 3,473,174 | A * | 10/1969 | Cool | A61G 7/1007 | 297/331 |
| 4,884,841 | A * | 12/1989 | Holley | A61G 5/14 | 297/331 |
| 5,063,617 | A * | 11/1991 | Ward | A61G 7/1007 | 297/DIG. 10 |
| 5,819,325 | A * | 10/1998 | Richards | A61G 7/1007 | 4/237 |
| 6,189,164 | B1 * | 2/2001 | Krapu | A61G 5/14 | 297/313 |
| 6,492,786 | B1 * | 12/2002 | Vang | A47C 1/0242 | 280/647 |
| 6,553,582 | B1 * | 4/2003 | Clark | A61G 7/1007 | 4/252.2 |
| 6,745,417 | B2 * | 6/2004 | Sumino | A47K 13/10 | 4/222 |
| 6,754,917 | B1 * | 6/2004 | Rhoades | A61G 7/1007 | 4/667 |
| 7,039,964 | B2 * | 5/2006 | Cavanagh | A61G 7/1007 | 4/246.1 |
| 9,078,796 | B1 * | 7/2015 | Hall | A61G 5/14 | |
| 9,326,608 | B1 * | 5/2016 | Hoy | A47C 1/03211 | |
| 2006/0042005 | A1 * | 3/2006 | Johnson | A61G 7/1007 | 4/667 |
| 2006/0207020 | A1 * | 9/2006 | Huff | A61G 7/1007 | 4/667 |
| 2007/0157376 | A1 * | 7/2007 | Paz | A47C 23/002 | 4/540 |
| 2008/0038107 | A1 * | 2/2008 | Henshaw | A61G 7/1007 | 414/816 |
| 2009/0144895 | A1 * | 6/2009 | Bostelman | A61G 7/1007 | 5/87.1 |
| 2013/0000040 | A1 * | 1/2013 | Conley | A47C 21/08 | 5/604 |
| 2015/0209207 | A1 * | 7/2015 | Cooper | A61G 5/1056 | 701/49 |

FOREIGN PATENT DOCUMENTS

| | | | |
|---|---|---|---|
| JP | 2015-228974 | A | 12/2015 |
| KR | 10-1204172 | B1 | 11/2012 |
| WO | WO 2017-156220 | A1 | 9/2017 |

OTHER PUBLICATIONS

Heartland America! (Mar. 2017) Easy Boost Seat—Regular; Available Web Site: http://www.heartlandamerica.com/easy-boost-seat-regular.html?SC=WIF20001&gclid=Cj0KEQiA9P7FBRCtoO33_LGUtPQBEiQAU_tBgPvnPd1lyY3y_FACeTikN3vXpJx_imTwLUmsIFLLIukaAgY18P8HAQ; Last updated: unknown; Accessed on: Mar. 8, 2017.

Gold Violin (Mar. 2017) Easy Boost Toilet Seat—Regular; Available Web Site: http://goldviolin.blair.com/p/72416.uts?c1=Y&cid=pl_gv_google&src_code=GVLPSGGO&pr_code=JNQE&adpos=1o2&creative=92625665293&device=c&matchtype=&network=g&gclid=Cj0KEQiA9P71FBRCtoO33_LGUtPQBEiQAU_tBgIJ9y_-MPO_qL6sKh5sL14hF2UFOpDqg-V7XKTMqQiMaAnRp8P8HAQ; Last updated: unknown; Accessed on: Mar. 8, 2017.

International Search Report and Written Opinion prepared by the Korean Intellectual Property Office as International Searching Authority for PCT International Patent Application No. PCT/US2017/021500, dated May 26, 2017, 14 pages.

International Preliminary Report on Patentability prepared by the International Bureau, PCT International Patent Application No. PCT/US2017/021500, dated Sep. 20, 2018, 11 pages.

* cited by examiner

METHOD, APPARATUS, AND SYSTEM FOR IMPLEMENTING SEAT LIFTING

CROSS-REFERENCES TO RELATED APPLICATIONS

This application claims priority to U.S. Patent Application Ser. No. 62/307,134 (the "'134 Application"), filed Mar. 11, 2016 by Stephen Latham, entitled, "Method, Apparatus, and System for Implementing Seat Lifting," the disclosure of which is incorporated herein by reference in its entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to methods, apparatuses, systems, and computer software for implementing seat lifting, and, in particular embodiments, to methods, apparatuses, systems, and computer software for implementing seat lifting for toilet seats, chairs, and/or the like.

BACKGROUND

For many individuals, such as the elderly, the infirm, and/or those with disabilities, it is at times very difficult, if not impossible, for them to rise from a seated position, without aid from another person. For example, getting of a toilet seat or a lounge chair, or the like, without the assistance of others, can be an ordeal, and, in some cases, can be a dangerous proposition.

Hence, there is a need for more robust and scalable solutions for implementing seat lifting, and, in particular embodiments, for implementing seat lifting for toilet seats, chairs, and/or the like.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Overview

Figure 1B:
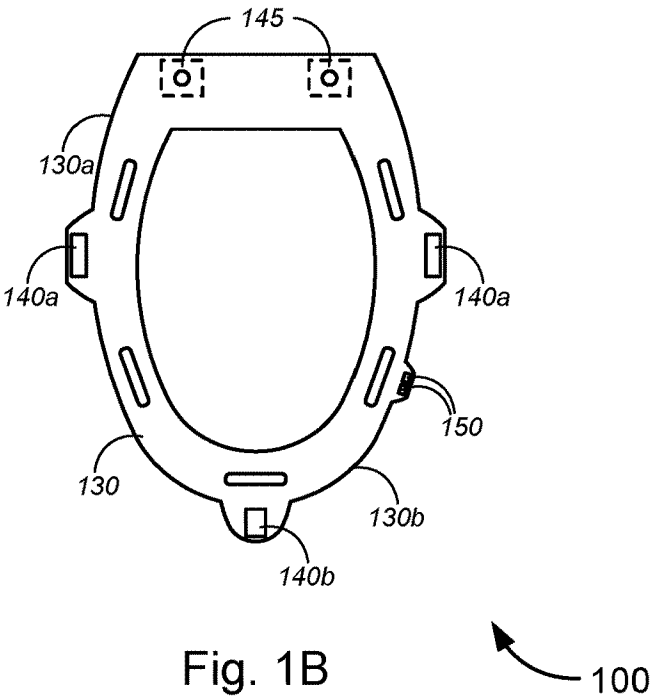
FIGS. 1A-1J are schematic diagrams illustrating various apparatuses and systems for implementing seat lifting for toilet seats, in accordance with various embodiments.

Various embodiments provide tools and techniques for implementing seat lifting, and, in particular embodiments, for implementing seat lifting for toilet seats, chairs (including, but not limited to, lounge chairs, rocking chairs, reclining chairs, love seats, couches, benches, stools, office chairs, desk chairs, and/or the like), and/or the like.

In some embodiments, a seat lifter might comprise one or more first pistons, one or more second pistons, and a seat portion. The one or more first pistons, when actuated (e.g., in response to user input), might cause a rear portion of the seat portion of the seat lifter to lift relative to a front portion of the seat portion of the seat lifter, the rear portion of the seat portion of the seat lifter being lifted by a first height above a seat to which the seat lifter is affixed. The one or more second pistons, when actuated (e.g., in response to user input), might cause the front portion of the seat portion of the seat lifter to lift by a second height above the seat to which the seat lifter is affixed, the second height being less than the first height. In some instances, the one or more first pistons and the one or more second pistons might be actuated serially one after the other (in either order), or might be actuated concurrently. In response to a second user input or after a predetermined period of time (including, but not limited to 30 s, 1 minute, 2 minutes, 3 minutes, 5 minutes, etc.) after the seat portion has been lifted, the one or more first pistons might be actuated to lower the rear portion of the seat portion of the seat lifter by the first height, and/or the one or more second pistons might be actuated to lower the front portion of the seat portion of the seat lifter by the second height.

According to some embodiments, the seat lifter might lift a user from a sitting position to a standing position, while in other embodiments, the seat lifter might lower a user from a standing position to a sitting position. The user input, in some cases, might be received via at least one of a physical button, a touchscreen soft button, or a microphone on the seat lifter, via at least one of a physical button, a touchscreen soft button, or a microphone on a remote controller for the seat lifter, via at least one of a physical button, a touchscreen soft button, or a microphone on a user device associated with the user (which might include, but is not limited to, at least one of a tablet computer, a smart phone, a mobile phone, a personal digital assistant, an electronic medical aid device, or a laptop computer). In some embodiments, the seat lifter might be affixed (in some cases, removably affixed) to the seat, while, in alternative embodiments, the seat lifter and the seat might be built or constructed as a unitary piece of furniture or the like.

The following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The tools provided by various embodiments include, without limitation, methods, systems, and/or software products. Merely by way of example, a method might comprise one or more procedures, any or all of which are executed by a computer system. Correspondingly, an embodiment might provide a computer system configured with instructions to perform one or more procedures in accordance with methods provided by various other embodiments. Similarly, a computer program might comprise a set of instructions that are executable by a computer system (and/or a processor therein) to perform such operations. In many cases, such software programs are encoded on physical, tangible, and/or non-transitory computer readable media (such as, to name but a few examples, optical media, magnetic media, and/or the like).

In an aspect, a method might be provided for implementing seat lifting. The method might comprise receiving a user input from a user, the user input indicating a request for a seat lifter to lift the user from a sitting position; and in response to receiving the user input, actuating one or more first pistons to lift a rear portion of a seat portion of the seat lifter relative to a front portion of the seat portion of the seat lifter, the rear portion of the seat portion of the seat lifter being lifted by a first height above a seat to which the seat lifter is affixed.

In some embodiments, the method might further comprise after a predetermined period, actuating the one or more first pistons to lower the rear portion of the seat portion of the seat lifter by the first height. In some cases, the method might further comprise in response to receiving the user input, actuating one or more second pistons to lift the front portion of the seat portion of the seat lifter by a second height above the seat to which the seat lifter is affixed, the second height being less than the first height. In some instances, the method might further comprise after a predetermined period, actuating the one or more second pistons to lower the front portion of the seat portion of the seat lifter by the second height.

Merely by way of example, according to some embodiments, receiving the user input from the user might comprise one of receiving the user input from the user via at least one of a physical button, a touchscreen soft button, or a microphone on the seat lifter; receiving the user input from the user via at least one of a physical button, a touchscreen soft button, or a microphone on a remote controller for the seat lifter; or receiving the user input from the user via at least one of a physical button, a touchscreen soft button, or a microphone on a user device associated with the user. The user device associated with the user might comprise at least one of a tablet computer, a smart phone, a mobile phone, a personal digital assistant, an electronic medical aid device, or a laptop computer, and/or the like.

According to some embodiments, the seat to which the seat lifter is affixed might comprise one of a toilet fixture or a toilet seat, and/or the like. In some embodiments, the method might further comprise receiving a second user input from the user, the second user input indicating a request for to lift a foot rest portion to an elevated position and, in response to receiving the second user input, actuating one or more third pistons to lift the foot rest portion to the elevated position relative to a floor surface. Alternatively, the seat to which the seat lifter is affixed might comprise one of a lounge chair, a rocking chair, a reclining chair, a love seat, a couch, a bench, a stool, an office chair, or a desk chair, and/or the like.

In another aspect, a seat lifter might comprise a seat portion, the seat portion comprising a front portion and a rear portion; an input device that receives a user input from a user, the user input indicating a request for the seat lifter to lift the user from a sitting position; and one or more first pistons coupled to the rear portion of the seat portion, the one or more first pistons, when actuated in response to receiving the user input, causing the rear portion of the seat portion of the seat lifter to lift relative to the front portion of the seat portion of the seat lifter, the rear portion of the seat portion of the seat lifter being lifted by a first height above a seat to which the seat lifter is affixed.

In some embodiments, the seat lifter might further comprise at least one processor and a non-transitory computer readable medium communicatively coupled to the at least one processor. The non-transitory computer readable medium might have stored thereon computer software comprising a set of instructions that, when executed by the at least one processor, causes the seat lifter to: in response to receiving the user input, actuate the one or more first pistons to lift the rear portion of the seat portion of the seat lifter relative to the front portion of the seat portion of the seat lifter.

In some instances, after a predetermined period, the one or more first pistons are actuated to lower the rear portion of the seat portion of the seat lifter by the first height. According to some embodiments, the seat lifter might further comprise one or more second pistons coupled to the front portion of the seat portion, the one or more second pistons, when actuated in response to receiving the user input, causing the front portion of the seat portion of the seat lifter to lift by a second height above the seat to which the seat lifter is affixed, the second height being less than the first height. In some cases, after a predetermined period, the one or more second pistons are actuated to lower the front portion of the seat portion of the seat lifter by the second height.

Merely by way of example, in some embodiments, the input device might comprise at least one of a physical button, a touchscreen soft button, or a microphone on the seat lifter. Alternatively, or additionally, the input device might comprise a transceiver that communicatively couples to a remote controller, the remote controller comprising at least one of a physical button, a touchscreen soft button, or a microphone. Alternatively, or additionally, the input device comprises a transceiver that communicatively couples to a user device associated with the user, the user device comprising at least one of a physical button, a touchscreen soft button, or a microphone.

According to some embodiments, the seat to which the seat lifter is affixed might comprise one of a toilet fixture or a toilet seat, and/or the like. In some embodiments, the seat lifter might further comprise a foot rest portion and one or more third pistons coupled to the foot rest portion, the one or more third pistons, when actuated in response to receiving a second user input via the input device, causing the foot rest portion to lift to an elevated position relative to a floor surface. Alternatively, the seat to which the seat lifter is affixed might comprise one of a lounge chair, a rocking chair, a reclining chair, a love seat, a couch, a bench, a stool, an office chair, or a desk chair, and/or the like. In some cases, the seat to which the seat lifter is affixed and the seat lifter are separable components that are constructed separately and subsequently affixed together. In such cases, the seat lifter might further comprise a base portion, the base portion comprising one or more anchor portions that affix to one or more corresponding portions of the seat to which the seat lifter is affixed. Alternatively, the seat to which the seat lifter is affixed and the seat lifter are integral components that are constructed as a unitary piece.

Various modifications and additions can be made to the embodiments discussed without departing from the scope of the invention. For example, while the embodiments described above refer to particular features, the scope of this invention also includes embodiments having different combination of features and embodiments that do not include all of the above described features.

Specific Exemplary Embodiments

We now turn to the embodiments as illustrated by the drawings. FIGS. 1-6 illustrate some of the features of the method, system, and apparatus for implementing seat lifting, and, in particular embodiments, for implementing seat lifting for toilet seats, chairs (including, but not limited to, lounge chairs, rocking chairs, reclining chairs, love seats, couches, benches, stools, office chairs, desk chairs, and/or the like), and/or the like, as referred to above. The methods, systems, and apparatuses illustrated by FIGS. 1-6 refer to examples of different embodiments that include various components and steps, which can be considered alternatives or which can be used in conjunction with one another in the various embodiments. The description of the illustrated methods, systems, and apparatuses shown in FIGS. 1-6 is provided for purposes of illustration and should not be considered to limit the scope of the different embodiments.

Figure 1A:
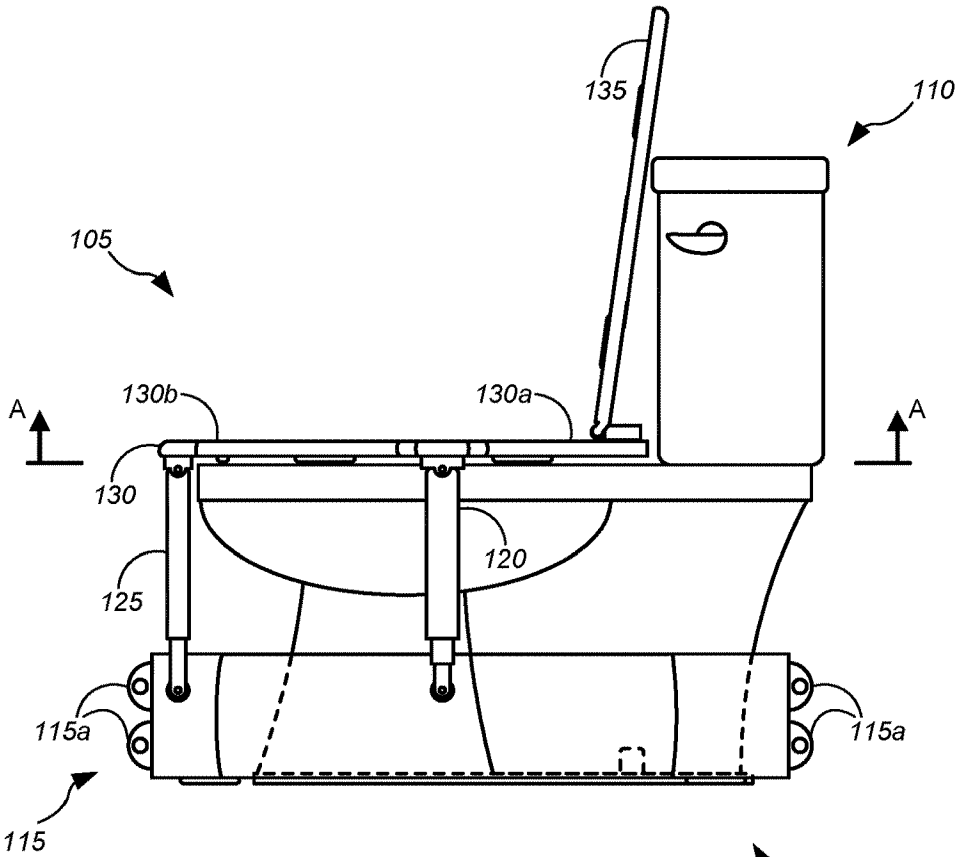
Figure 1D:
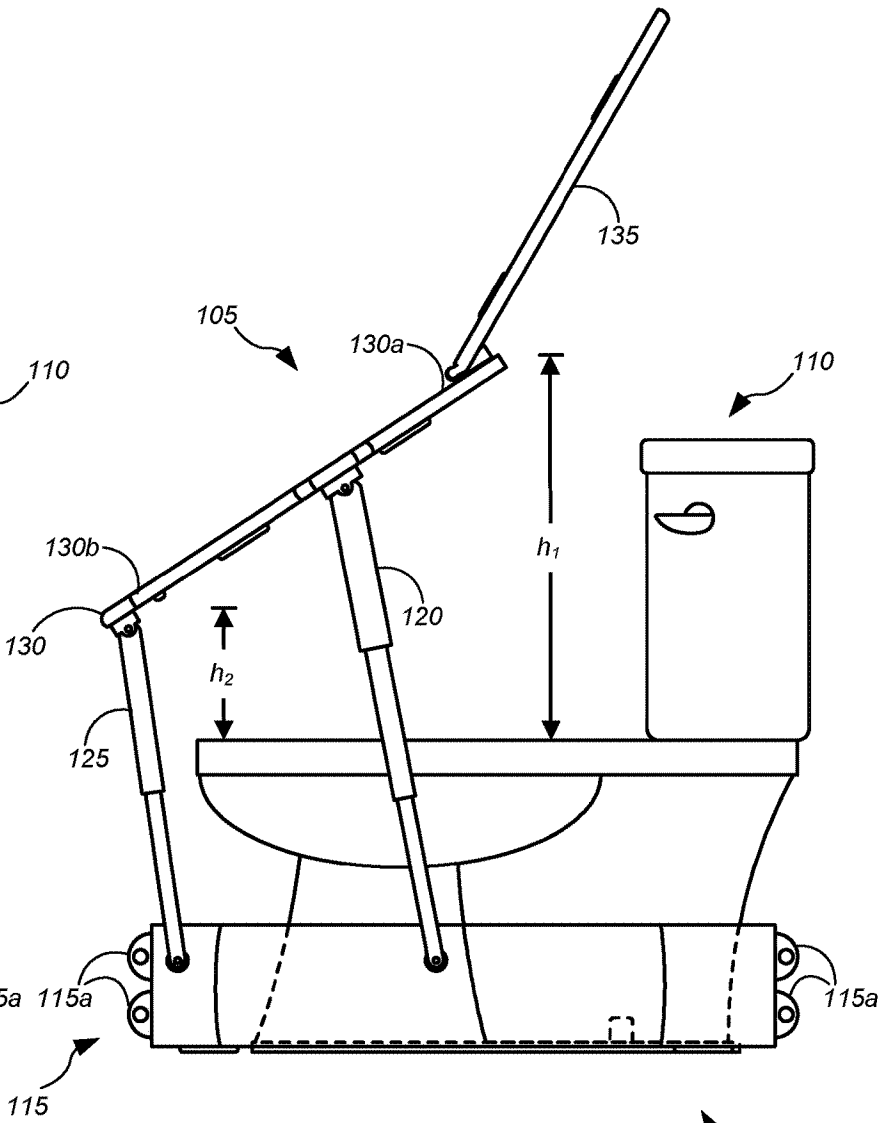
Figure 1C:
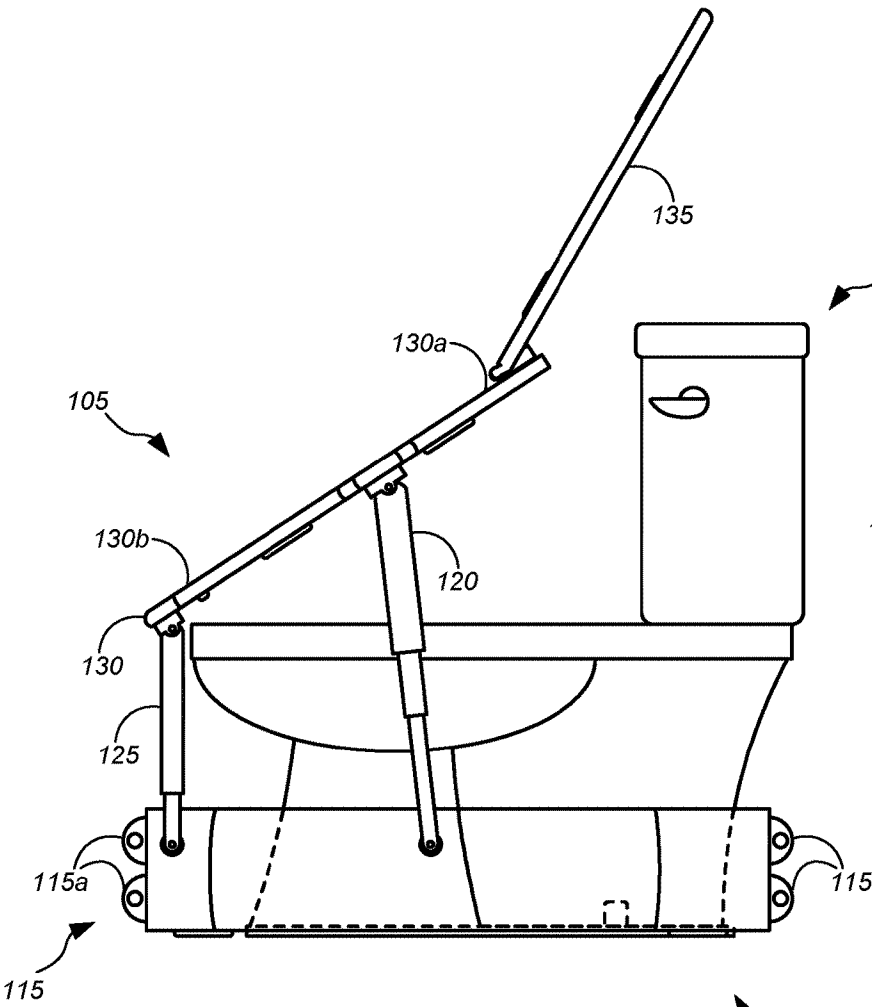
Figure 1F:
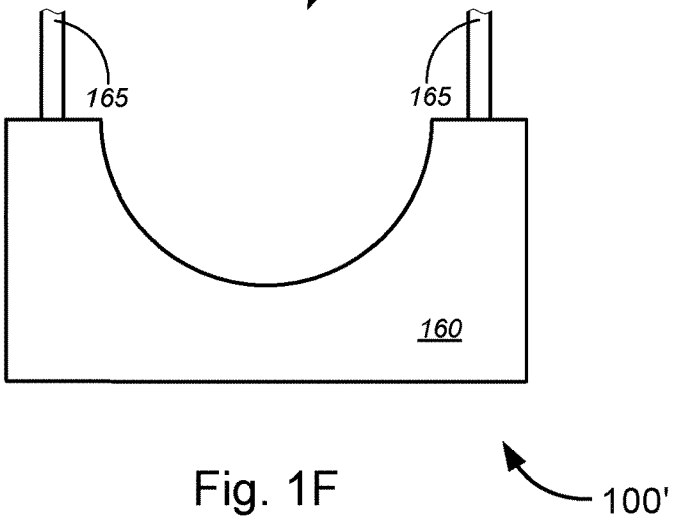
Figure 1E:
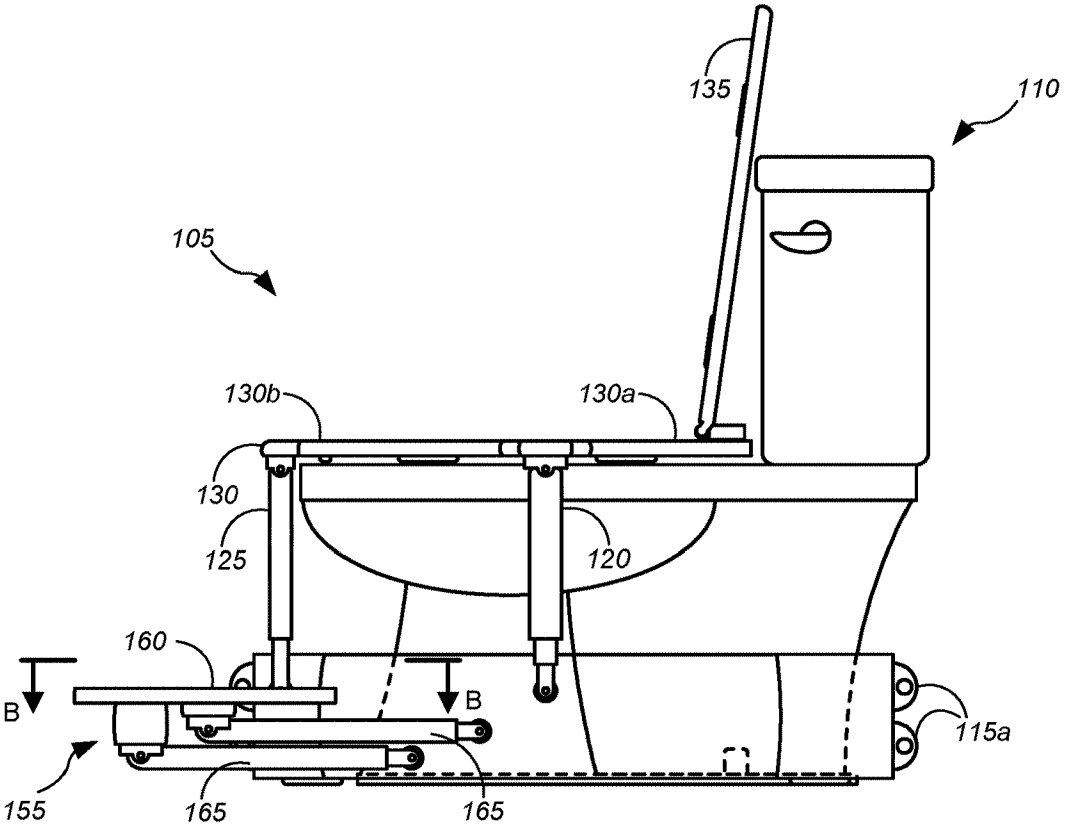
Figure 1G:
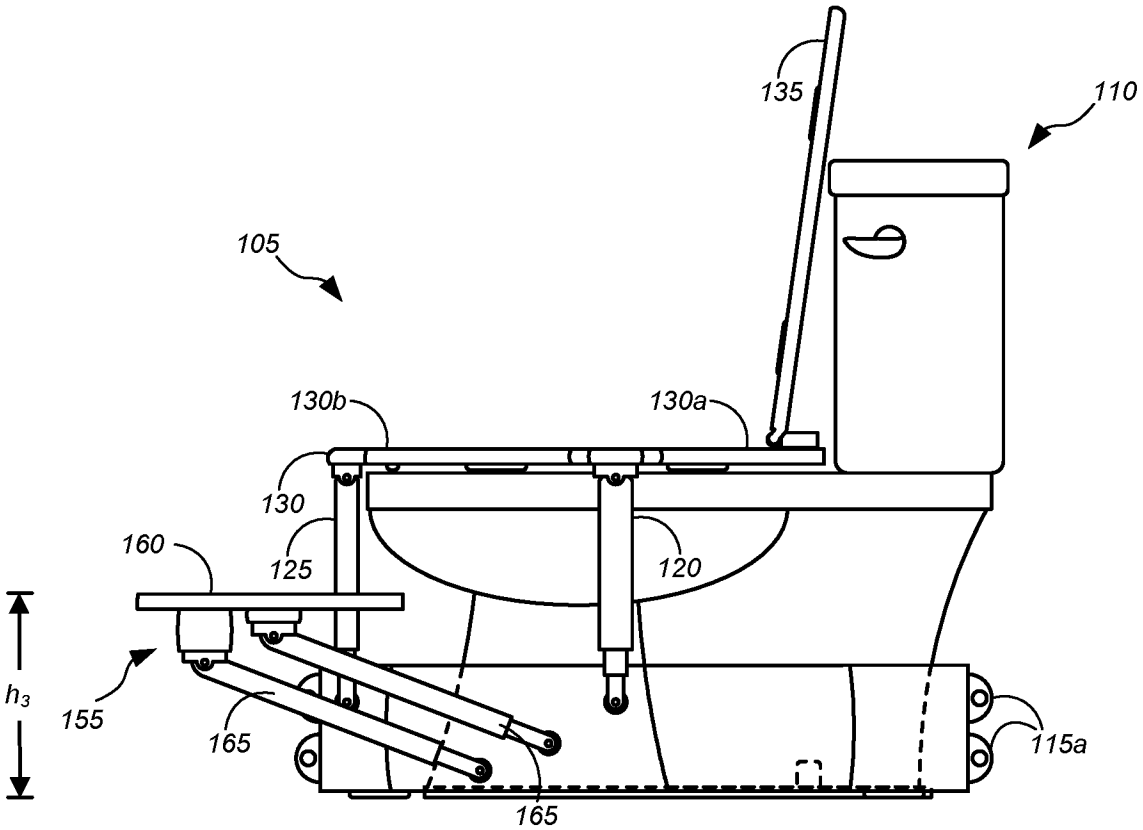
Figure 1H:
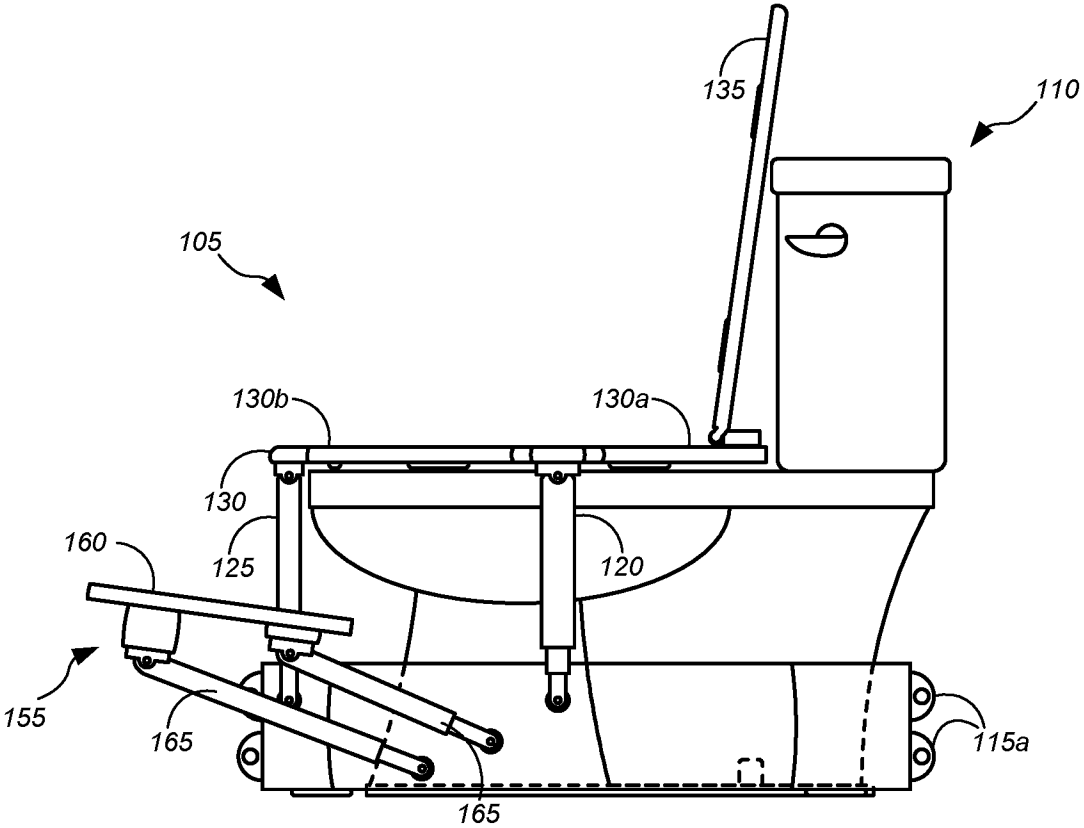
Figure 1J:
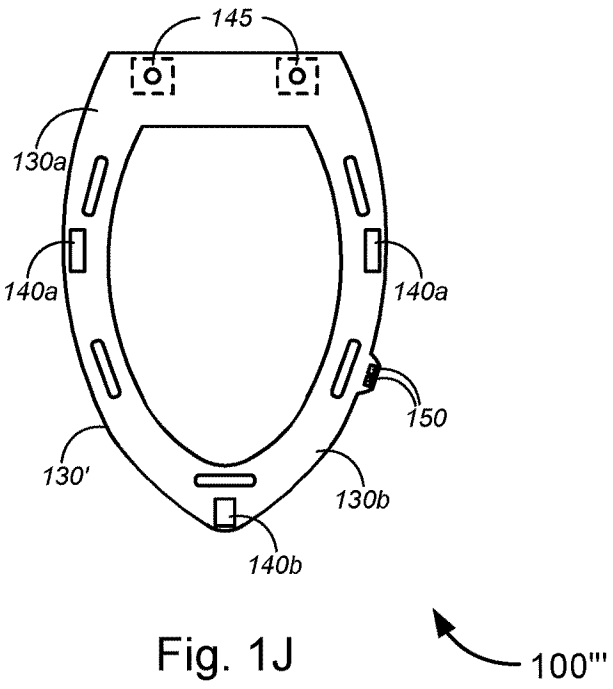
Figure 1I:
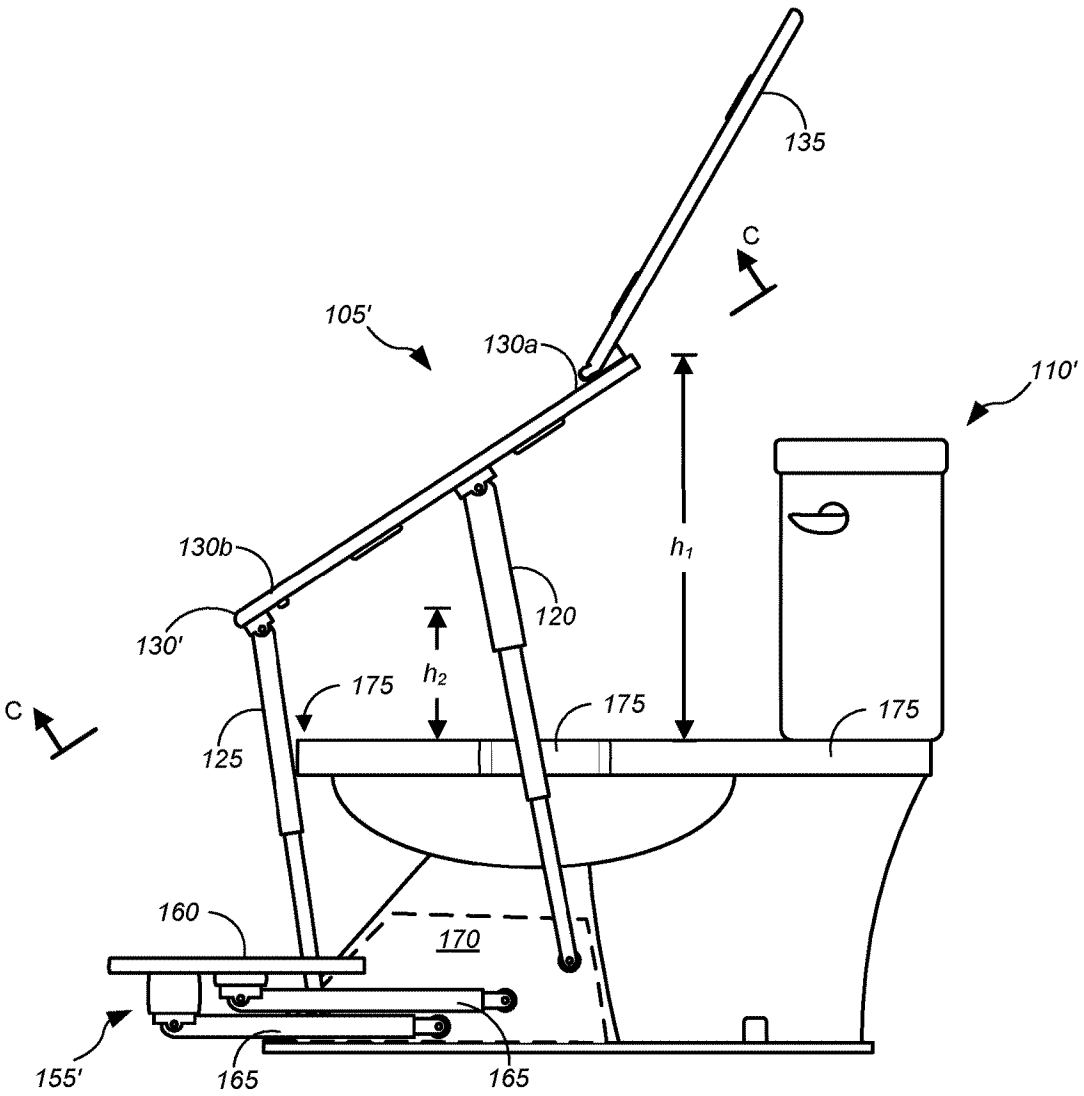

With reference to the figures, FIGS. 1A-1J (collectively, "FIG. 1") are schematic diagrams illustrating various apparatuses and systems 100, 100', 100", and 100'" for implementing seat lifting for toilet seats, in accordance with various embodiments. FIG. 1A depicts a seat lifter 105 that is affixed to, or embodied within, a toilet 110, while FIG. 1B depicts a bottom view of the seat lifter 105 as shown along the A-A direction indicated in FIG. 1A and rotated by 90 degrees with the rear portion 130*a* shown above the front portion 130*b*, and FIGS. 1C and 1D depict the seat lifter 105 in different lift configurations or positions. FIG. 1E depicts, in addition to the seat lifter 105 of FIGS. 1A-1D, a foot lifter 155 that may be affixed to, or embodied within, a toilet 110, while FIG. 1F depicts a partial sectional top view of an embodiment of the foot lifter 155 as shown along the B-B direction indicated in FIG. 1E and rotated by 90 degrees with the portion affixed to the toilet being shown above the portion that is furthest from the toilet, and FIGS. 1G and 1H depict various different lift positions or configurations of the foot lifter 155. FIG. 1I depicts a toilet 110' that has an integrated or built-in seat lifter 105' and an integrated or built-in foot lifter 155', while FIG. 1J depicts a bottom view of the seat lifter 105' as shown along the C-C direction indicated in FIG. 1I and rotated by 90 degrees with the rear portion 130*a* shown above the front portion 130*b*.

In FIG. 1A, system 100 might comprise a seat lifter 105 that is affixed to a toilet 110. The seat lifter 105 might comprise a base portion or anchor portion 115, which, in some embodiments, might comprise two side segments that couple to each over around the base of the toilet via connection interfaces 115*a* (and, in some cases, (custom) inserts that conform to the shape of the base of the toilet). According to some embodiments, the connection interfaces 115*a* might include, without limitation, thumb screw connections, nut/bolt connections, interlocking connections, screw-latch connections, adjustable latch connections, non-adjustable latch connections, a combination of two or more of these connections, and/or the like. The seat lifter 105 might further comprise one or more first pistons 120, one or more second pistons 125, and a seat portion 130. In some cases, a toilet lid 135 might be rotatably affixed to the seat portion 130.

With reference to FIG. 1B, the seat portion 105 might comprise a rear portion 130*a* and a front portion 130*b*. The seat portion 105 might couple to each of the one or more first pistons 120 via corresponding one or more first connection points 140*a* (with two shown in the embodiment of FIG. 1B), and might couple to each of one or more second pistons 125 via corresponding one or more second connection points 140*b* (with one shown in the embodiment of FIG. 1B). The lid 135 might rotatably affix to the seat portion 130 via one or more connection points 145. In some embodiments, the seat lifter might further comprise physical user interface device 150, which are depict as buttons or switches 150 on the right-side of the seat lifter 105 (near the front portion 130*b*). The various embodiments are not so limited, and the physical user interface device 150 may instead be positioned in any suitable position that can be easily reached by the user, including, but not limited to, on the left-side of the seat lifter 105 (near the front portion 130*b*) (not shown), hanging on a wall mount connected by wires to the seat portion or to the anchor portion (not shown), and/or the like. The buttons or switches 150 might electrically couple to the base portion 115 (which might house motors and power supplies (not shown)) that cause at least one of the one or more first pistons 120 and/or the one or more second pistons 125 to lift or lower the seat portion relative to the seat of the toilet 110.

In operation, as shown in FIG. 1C, in response to user input (for example), the one or more first pistons 120 might be actuated to lift the rear portion 130*a* of the seat portion 130 of the seat lifter 105 relative to the front portion 130*b* of the seat portion 130 of the seat lifter 105. As shown in FIG. 1D, the rear portion 130*a* of the seat portion of the seat lifter might be lifted by a first height $h_1$ above a seat or rim of the toilet 110 to which the seat lifter 105 is affixed, while the one or more second pistons 125 might be actuated to lift the front portion 130*b* of the seat portion 130 of the seat lifter 105 by a second height $h_2$ above the seat or rim of the toilet 110 to which the seat lifter is affixed. In some cases, the seat lifter 105, when in the lifted or raised position might be tilted in front of or away from the toilet 110 (as shown), while in other cases, the front portion 130*b* of the seat portion 130 of the seat lifter 105 might be lifted almost completely vertically (not shown). As shown in FIG. 1D, the second height $h_2$ is less than the first height $h_1$. In some cases, $h_2$ might be about 0 to 6 inches (0 cm to ~15.24 cm), while $h_1$ might be about 10 to 12 inches (~25.40 cm to ~30.48 cm) or about 12 to 15 inches (~30.48 cm to ~38.10 cm), depending on the height of the toilet. The various embodiments are not so limited, and $h_1$ and $h_2$ can be any appropriate heights so long as the second height $h_2$ is less than the first height $h_1$.

In terms of materials, the seat portion 130 of the seat lifter 105 might be made of metal, rigid product plastic, and/or the like, while the base, which might be flared at the bottom to maintain solid contact with the floor, might be made of wood or heavy plastic product, and/or the like that is generally shaped to fit around most toilets at the base. In some embodiments (not shown), a securing ring might be added at the top of the toilet rim or the top of the water tank of the toilet to enhance stability of the seat lifter 105. According to some embodiments (also not shown), a soft inner lining might be used between the anchor or other portion of the seat lifter and the toilet, so that there is no damage to the toilet when the (anchor base of the) seat lifter is secured around the (base of the) toilet 110. In some cases (not shown), a foam product insert might also be used to provide additional contact protection between the seat lifter and the toilet.

In some embodiments, a foot lifter 155 might be additionally affixed to the toilet, in some cases, via the base portion or anchor portion 115. By lifting a person's feet while the person is seated on the toilet 110 (or in some cases, seated on the seat lifter 105 that is affixed to or integrated within the toilet 110), the resultant squatted position of the person might facilitate bowel movement. According to some embodiments, the foot lifter 155 might comprise a foot rest portion 160 (on which the person's feet might be placed when the person is seated on the toilet) and one or more third pistons 165. In some cases, the one or more third pistons 165 might comprise four pistons 165, with a first pair of pistons (one on either side of the toilet) being coupled or affixed to a front portion of the foot rest portion 160 (the front portion being furthest from or facing away from the toilet) while a second pair of pistons (one on either side of the toilet) being coupled or affixed to a middle portion of the foot rest portion 160 (the middle portion being closer to the toilet compared with the front portion). In some instances (as shown in the embodiment of FIG. 1H), the second pair of pistons (one on either side of the toilet) might alternatively be coupled or affixed to a rear portion of the foot rest portion 160 (the rear portion being closest to the toilet and in some cases might be positioned on either side of the toilet).

With reference to FIG. 1F, the foot rest portion 160 of the foot lifter 155 might have a semi-circular (or other shaped) cut-out that allows the foot rest portion to be lifted while being close to the toilet without contacting the toilet bowl or other portions of the toilet. A partial sectional view of the tops of the second pair of pistons 165 is also shown in FIG. 1F.

In operation, as shown in FIG. 1G, in response to user input (for example), the one or more third pistons 165 might be actuated to lift the foot rest portion 160 of the foot lifter 155 relative to the base portion or anchor portion 115, so as to elevate the feet of the person who is seated on the (seat lifter 105 of the) toilet 110. The two pairs of pistons 165 allow the foot rest portion 160 to be lifted while maintaining a level surface on which the person's feet are rested or positioned. The two pairs of pistons also allows the system to support the weight of the person (or at least the weight of the person's legs) as the person's feet are being lifted. In some cases, the two pairs of pistons might alternatively allow the foot rest portion 160 to be tilted with the front portion being slightly higher than the rear portion (as shown in the embodiment of FIG. 1H), so as to provide a more comfortable squatted position for the person while preventing the person from tilting to far forward and potentially falling in front of the toilet 110. In some cases, the foot rest portion 160 might be lifted by a height of $h_3$ with respect to the surface of the floor (i.e., with respect to the bottom of the base portion 115). The height $h_3$, in some embodiments, might be set to be anywhere between about 1 or 2 to 8 inches (~2.54 cm or ~5.08 cm to ~20.32 cm), with the lower end of this range being the minimum height that still allows the pistons to fit beneath the foot rest portion 160. The height of the foot rest portion can be adjusted by the person to fit the comfort level of the person (and preset or customized values ($h_3$, as well as each of $h_1$ and $h_2$) can be stored in the system's memory for each of the two or more people who use the toilet).

In embodiment 100''' of FIG. 1I, a toilet 110' comprises an integrated or built-in seat lifter 105' (which is otherwise similar, if not identical, at least in general structure and functionality as seat lifter 105 as shown and described above with respect to FIGS. 1A-1H, or the like), an integrated or built-in foot lifter 155' (which is otherwise similar, if not identical, at least in general structure and functionality as foot lifter 155 as shown and described above with respect to FIGS. 1E-1H, or the like), and built-in electrical and/or mechanical system 170 that is constructed within the toilet 110' itself and that communicatively couple to the motors and electronic controls (and, in some cases, the processor, memory, communications systems, and other electronics, etc.) to the pistons 120, 125, and 165, as well as to physical user interface device 150, and/or the like. Grooves 175 in the toilet 110' provide for more compact integration of the pistons 120 and 125 (i.e., closer to the toilet bowl of toilet 110'), while allowing freedom of motion of the pistons 120 and 125 during operation. Accordingly, the shape of the seat portion 130' can be made to be similar to the shape of conventional elongated toilet seats without protrusions for the pistons 120 and 125. The seat portion 130' (as shown in FIG. 1J) might otherwise be similar to the seat portion 130 of FIGS. 1A-1H. In some cases, the protrusion on which the physical user interface device 150 for the seat portion 130' might be similar to the corresponding protrusion for the seat portion 130. Alternatively, there may be no physical user interface device 150 integrated within the seat portion 150 (not shown in FIG. 1), while, in other cases, the physical user interface device 150 might be housed within a seat portion that has no protrusions (not unlike the connection points 140*a* and 140*b*), where a groove similar to grooves 175 might be provided in the toilet bowl of toilet 110' to allow the user access to the physical user interface device 150.

According to some embodiments, although not shown in FIG. 1, the toilet 110' might comprise the integrated or built-in seat lifter 105' (which is otherwise similar, if not identical, at least in general structure and functionality as seat lifter 105 as shown and described above with respect to FIGS. 1A-1H, or the like) and the built-in electrical and/or mechanical system 170, but not the integrated or built-in foot lifter 155'.

Figure 2B:
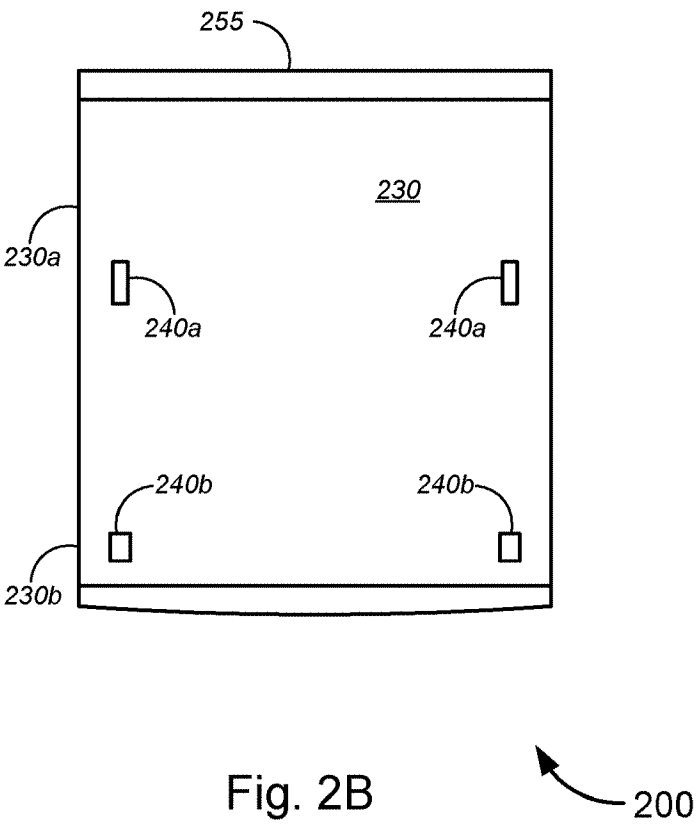
FIGS. 2A-2D are schematic diagrams illustrating an apparatus and a system for implementing seat lifting for chairs, in accordance with various embodiments.
Figure 2A:
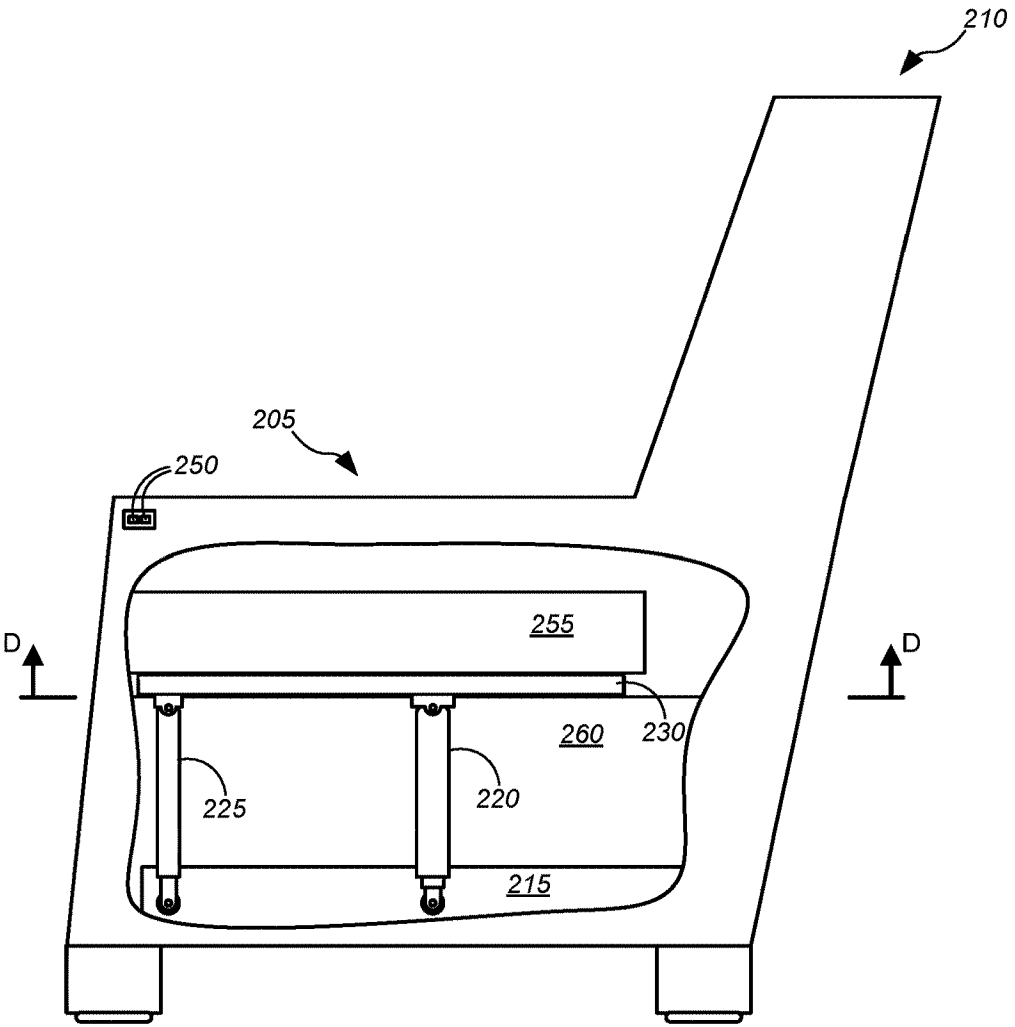
Figure 2D:
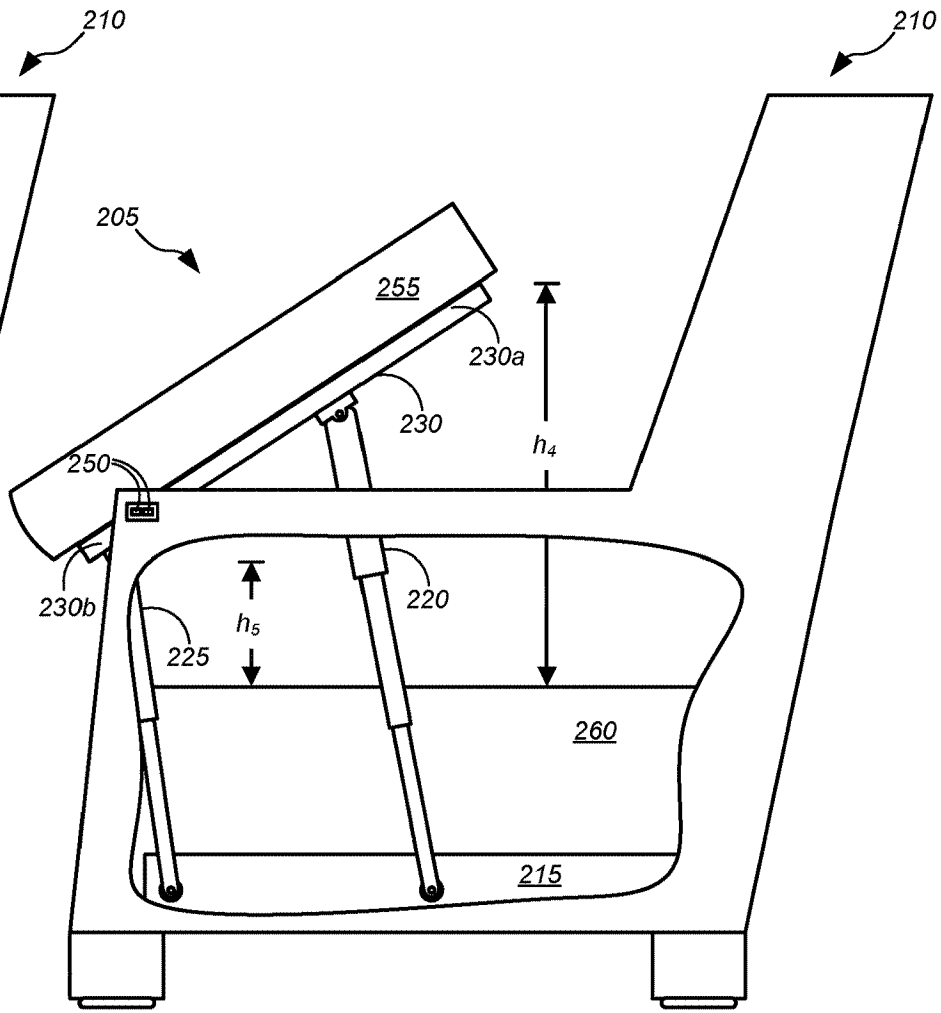
Figure 2C:
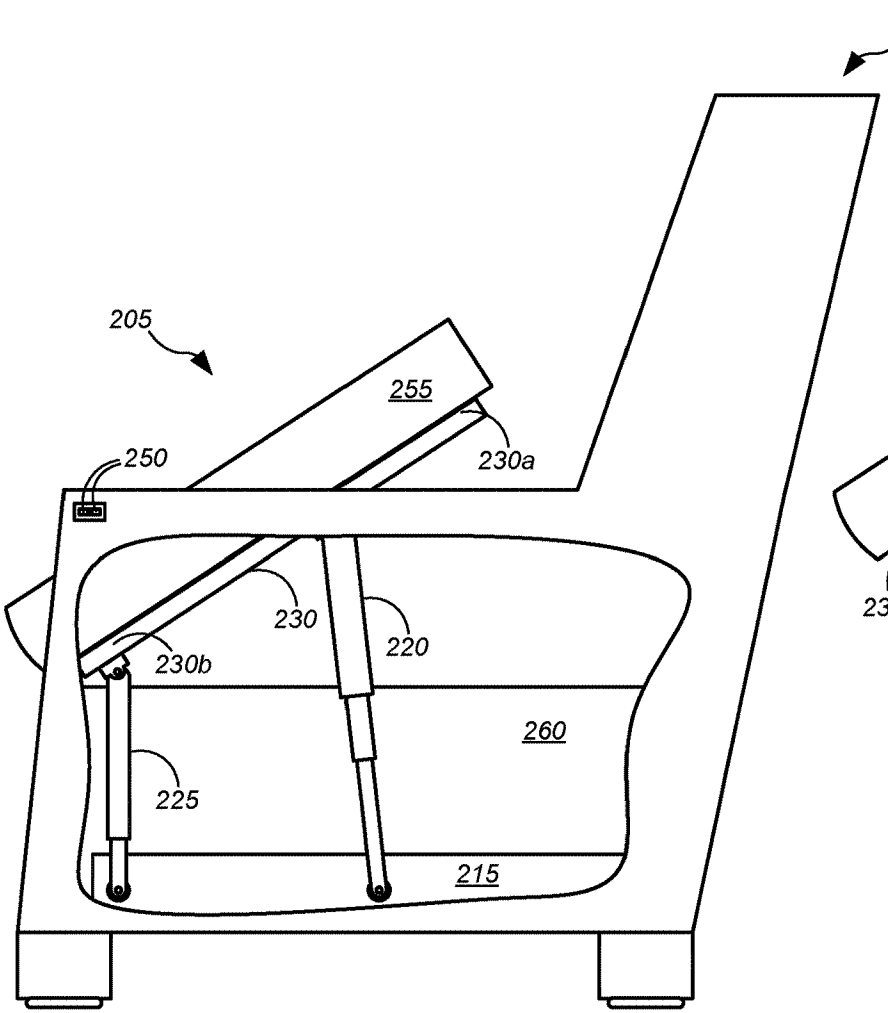

FIGS. 2A-2D (collectively, "FIG. 2") are schematic diagrams illustrating an apparatus and a system 200 for implementing seat lifting for chairs, in accordance with various embodiments. FIG. 2A depicts a seat lifter that is affixed to, or embodied within, a chair (which is depicted in FIG. 2A as a lounge chair, but not limited thereto), while FIG. 2B depicts a bottom of the seat lifter 205 as shown along the D-D direction indicated in FIG. 2A and rotated by 90 degrees with the rear portion 230*a* shown above the front portion 230*b*, and FIGS. 2C and 2D depict the seat lifter in different lift configurations or positions. In FIGS. 2A, 2C, and 2D, the inner components, including the seat lifter 205, the seat base 260, and other components, are visible through a cut-out in the side of the chair 210.

In FIG. 2A, system 200 might comprise a seat lifter 205 that is affixed to a chair 210, which might include, without limitation, a lounge chair, a rocking chair, a reclining chair, a love seat, a couch, a bench, a stool, an office chair, or a desk chair, and/or the like. The seat lifter 205 might comprise a base portion or anchor portion 215, which, in some embodiments, might be mounted within, or under, a bottom portion of the chair 210. The seat lifter 205 might further comprise one or more first pistons 220, one or more second pistons 225, and a seat portion 230. In some cases, a seat cushion 255 might be affixed to the seat portion 230 (in some cases, removably affixed).

With reference to FIG. 2B, the seat portion 205 might comprise a rear portion 230*a* and a front portion 230*b*. The seat portion 205 might couple to each of the one or more first pistons 220 via corresponding one or more first connection points 240*a* (with two shown in the embodiment of FIG. 2B), and might couple to each of one or more second pistons 225 via corresponding one or more second connection points 240*b* (with two shown in the embodiment of FIG. 2B). In some embodiments, the seat lifter might further comprise physical user interface device 250, which are depicted as buttons or switches 250 on the outer side of the arm rest of the chair 210 (near the front of the chair 210). The various embodiments are not so limited, and the physical user interface device 250 may instead be positioned in any suitable position that can be easily reached by the user, including, but not limited to, on the inner side of the chair 210 (near the front of the chair 210) (not shown), on a side of the seat portion 230 reachable along the sides of the cushion 255 or reachable between cushion 255 and another cushion of the chair 210 (not shown), and/or the like. The buttons or switches 250 might electrically couple to the base portion 215 (which might house motors and power supplies (not shown)) that cause at least one of the one or more first pistons 220 and/or the one or more second pistons 225 to lift or lower the seat portion relative to the seat of the chair 210.

In operation, as shown in FIG. 2C, in response to user input (for example), the one or more first pistons 220 might be actuated to lift the rear portion 230*a* of the seat portion 230 of the seat lifter 205 relative to the front portion 230*b* of the seat portion 230 of the seat lifter 205. As shown in FIG. 2D, the rear portion 230*a* of the seat portion of the seat lifter might be lifted by a first height $h_4$ above a seat base 260 of the chair 210 to which the seat lifter 205 is affixed, while the one or more second pistons 225 might be actuated to lift the front portion 230*b* of the seat portion 230 of the seat lifter 205 by a second height $h_5$ above the seat base 260 of the chair 210 to which the seat lifter is affixed. In some cases, the seat lifter 205, when in the lifted or raised position might be tilted in front of or away from the chair 210 (as shown), while in other cases, the front portion 230*b* of the seat portion 230 of the seat lifter 205 might be lifted almost completely vertically (not shown). As shown in FIG. 2D, the second height $h_5$ is less than the first height $h_4$. In some cases, $h_5$ might be about 0 to 6 inches (0 cm to ~15.24 cm), while $h_4$ might be about 10 to 12 inches (~25.40 cm to ~30.48 cm) or about 12 to 15 inches (~30.48 cm to ~38.10 cm), depending on the height of the chair. The various embodiments are not so limited, and $h_4$ and $h_5$ can be any appropriate heights so long as the second height $h_5$ is less than the first height $h_4$. The height of the seat lifter can be adjusted by the seated person to fit his or her comfort level, and preset or customized values $h_4$ and $h_5$ can be stored in the system's memory for each of the two or more people who use the chair.

In terms of materials, the seat portion 230 of the seat lifter 205 might be made of metal, rigid product plastic, wood (e.g., plywood or other wood pieces), and/or the like, while the base might be made of wood or heavy plastic product, and/or the like that is generally shaped to fit within the bottom of the chair or under the bottom of the chair.

Figure 3A:
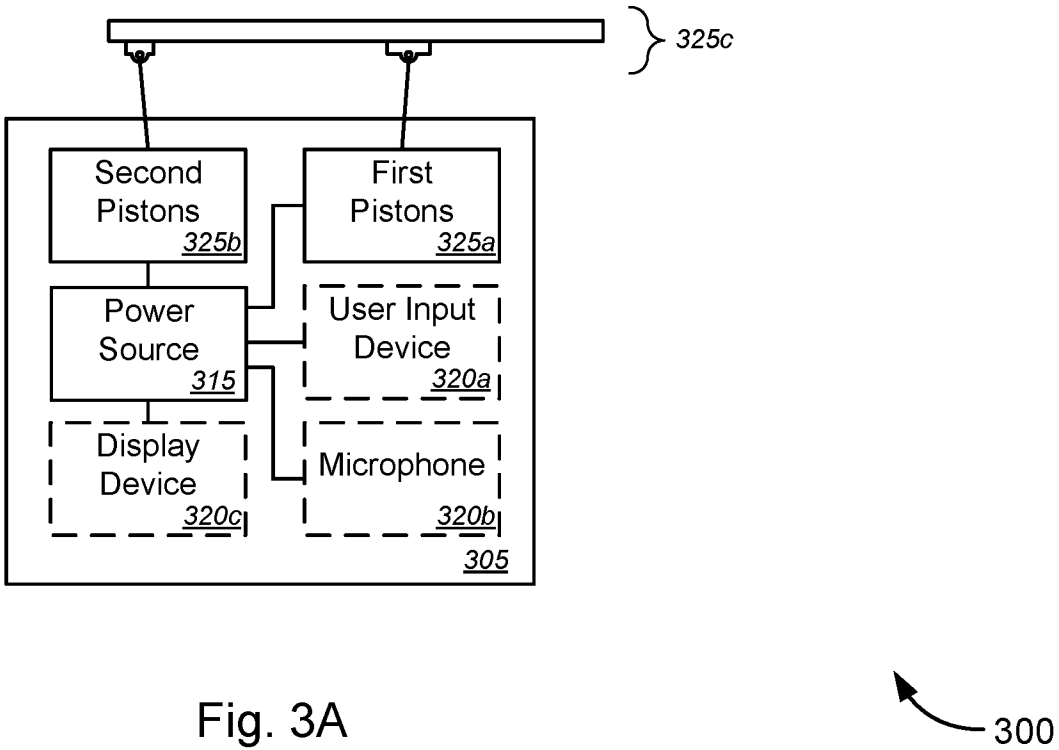
FIGS. 3A-3D are schematic block diagrams illustrating various embodiments of an apparatus and a system for implementing seat lifting.
Figure 3B:
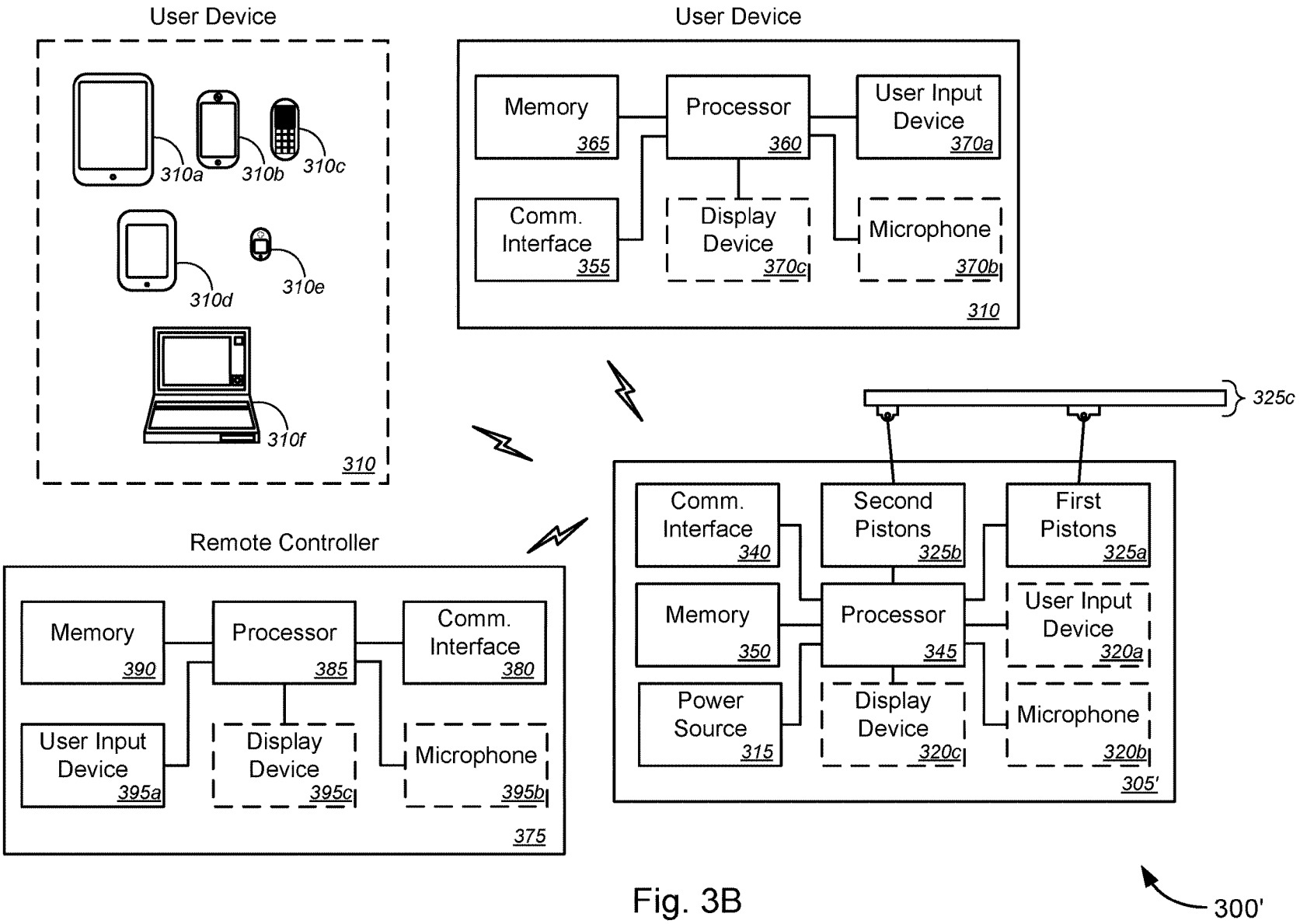
Figure 3C:
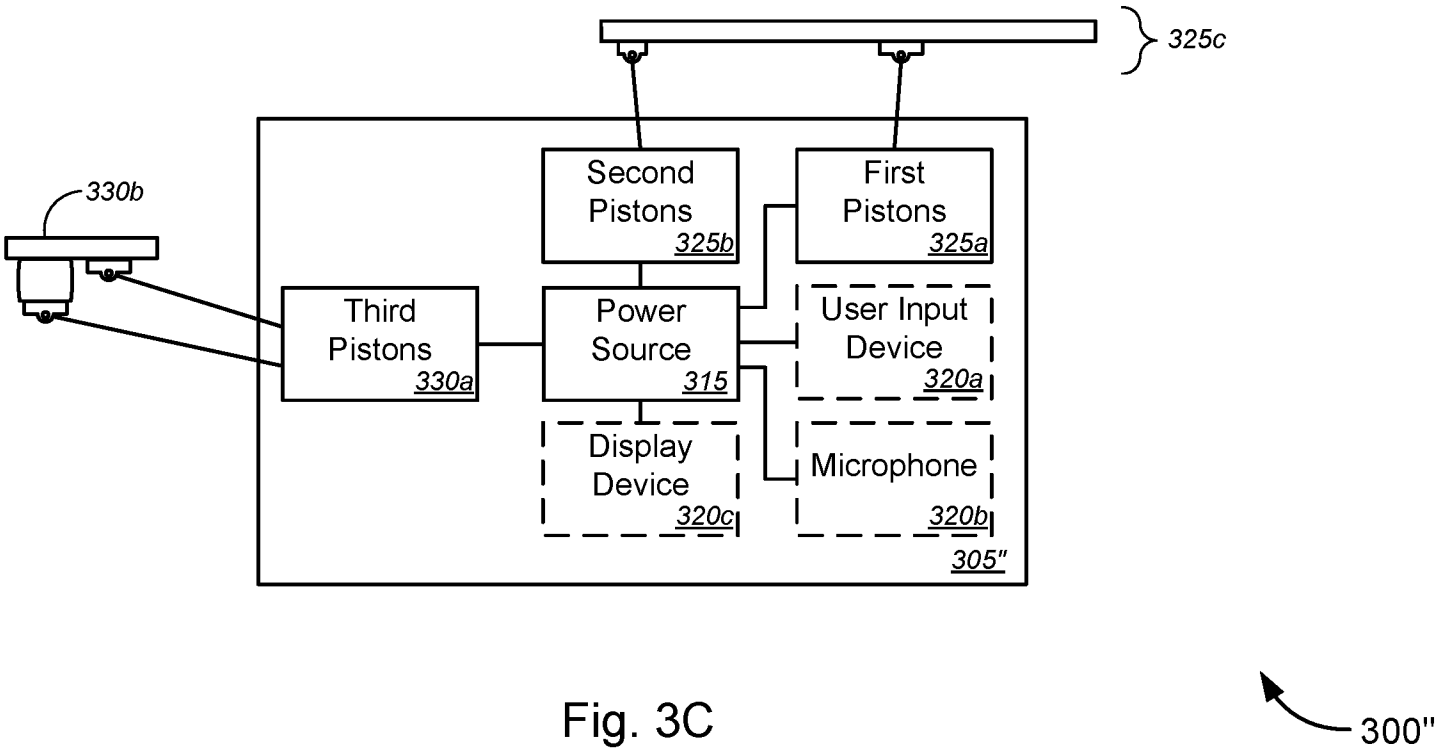
Figure 3D:
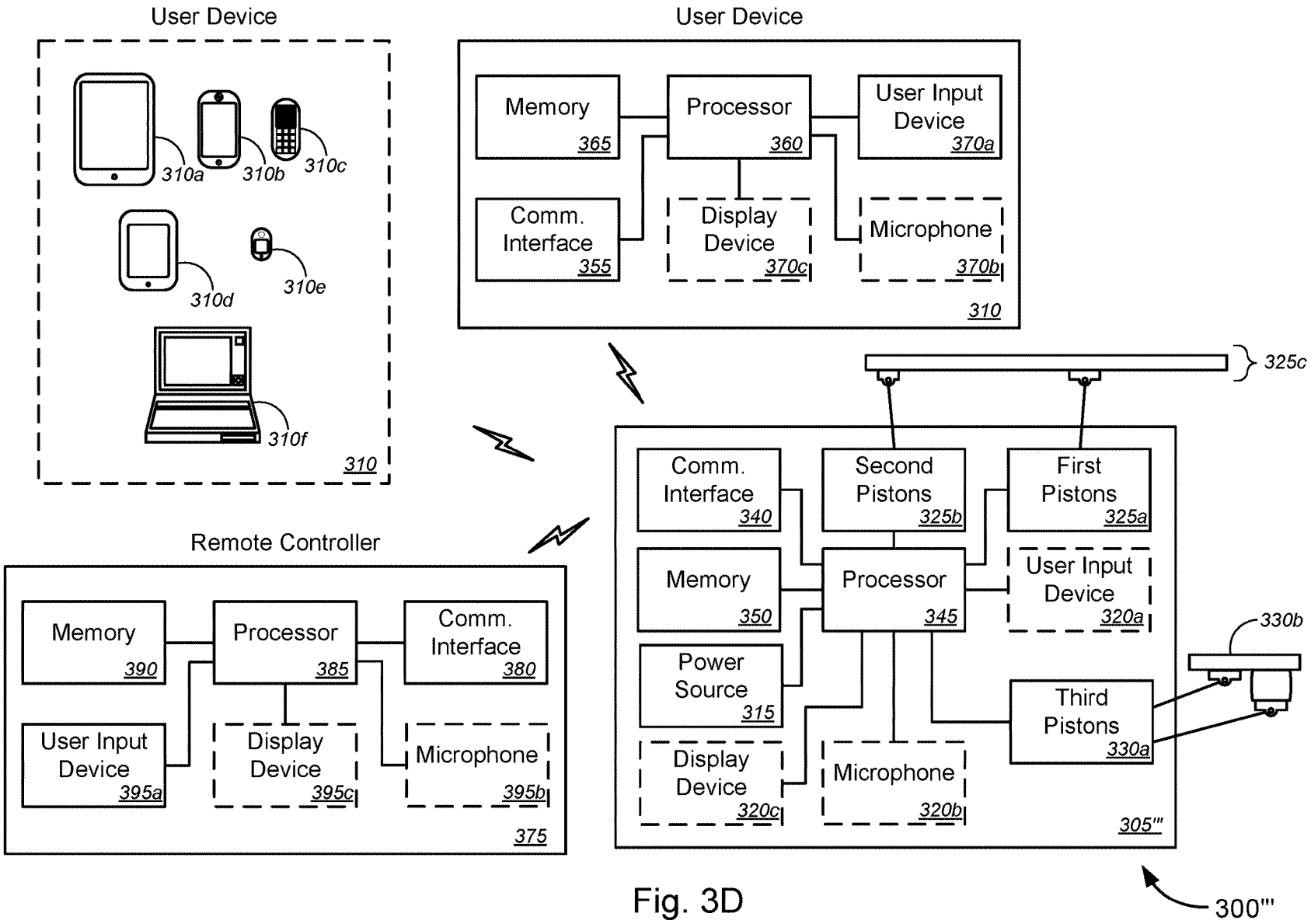

FIGS. 3A-3D (collectively, "FIG. 3") are schematic block diagrams illustrating various embodiments 300, 300', 300", and 300''' of an apparatus and a system for implementing seat lifting. FIG. 3A depicts an embodiment 300 that performs seat lifting, using mainly mechanical or hydraulic components and without interactions with external devices, while FIG. 3B depicts an embodiment 300' that performs seat lifting while having the capability of interacting with one or more user devices or with a remote controller for performing seat lifting. FIG. 3C depicts an embodiment 300" that performs a combination of seat lifting and foot lifting, using mainly mechanical or hydraulic components and without interactions with external devices, while FIG. 3D depicts an embodiment 300''' that performs a combination of seat lifting and foot lifting while having the capability of interacting with one or more user devices or with a remote controller for performing seat lifting and/or foot lifting.

With reference to FIG. 3A, a seat lifter 305 might comprise a power source 315, one or more user interface devices 320, one or more first pistons 325*a*, and one or more second pistons 325*b*. In some instances, the power source 315 might be one or more of a power supply that plugs into a wall socket; a non-chargeable, replaceable battery; or a power outlet rechargeable battery; or the like. The one or more user interface devices 320, in some embodiments, might include, without limitation, at least one of a user input device 320*a* (which in some instances might be a physical button, switch, lever, and/or the like), a microphone 320*b*, and/or a display device 320*c* (which in some cases might be a touchscreen display or a non-touchscreen display, or the like). The one or more first pistons 325*a* and/or the one or more second pistons 325*b* might be mechanically coupled to a seat portion 325*c* of the seat lifter 305. In some cases, as shown with respect to FIGS. 1 and 2, the one or more first pistons 325*a*, when actuated, might cause a rear portion of the seat portion 325*c* to lift or lower with respect to a seat to which the seat lifter is affixed, while the one or more second pistons 325*b*, when actuated, might cause a front portion of the seat portion 325*c* to lift or lower with respect to the seat to which the seat lifter is affixed.

We now turn to FIG. 3B, which depicts an alternative embodiment 300' of a seat lifter 305', which comprises a power source 315, one or more user interface devices 320, one or more first pistons 325*a*, one or more second pistons 325*b*, a seat portion 325*c*, a communications interface 340, at least one processor 345, and a memory 350 (e.g., a non-transitory computer readable medium or the like). In some instances, as in embodiment 300 of FIG. 3A, the power source 315 might be one or more of a power supply that plugs into a wall socket; a non-chargeable, replaceable battery; or a power outlet rechargeable battery; or the like. The one or more user interface devices 320, in some embodiments, might include, without limitation, at least one of a user input device 320*a* (which in some instances might be a physical button, switch, lever, and/or the like), a microphone 320*b*, and/or a display device 320*c* (which in some cases might be a touchscreen display or a non-touchscreen display, or the like). The one or more first pistons 325*a* and/or the one or more second pistons 325*b* might be mechanically coupled to the seat portion 325*c* of the seat lifter 305'. In some cases, as shown with respect to FIGS. 1 and 2, the one or more first pistons 325*a*, when actuated, might cause a rear portion of the seat portion 325*c* to lift or lower with respect to a seat to which the seat lifter is affixed, while the one or more second pistons 325*b*, when actuated, might cause a front portion of the seat portion 325*c* to lift or lower with respect to the seat to which the seat lifter is affixed.

The one or more user devices 310, in some embodiments, might include, without limitation, a tablet computer 310*a*, a smart phone 310*b*, a mobile phone 310*c*, a personal digital assistant 310*d*, an electronic medical aid device 310*e*, or a laptop computer 310*f*, and/or the like. Each user device 310 might comprise components including, but not limited to, a communications interface 355, at least one processor 360, a memory 365 (e.g., a non-transitory computer readable medium or the like), and one or more user interface devices 370, and/or the like (such as a power source (not shown) or other components of particular user devices). The one or more user interface devices 370, in some embodiments, might include, without limitation, at least one of a user input device 370*a* (which in some instances might be a physical button, switch, lever, and/or the like), a microphone 370*b*, and/or a display device 370*c* (which in some cases might be a touchscreen display (which might include touchscreen soft buttons or the like) or a non-touchscreen display, or the like).

The remote controller 375, according to some embodiments, might include, without limitation, a communications interface 380, a processor 385, a memory 390, and one or more user interface devices 395, and/or the like (such as a power source (not shown) or other components of particular remote controllers). The one or more user interface devices 395, in some embodiments, might include, without limitation, at least one of a user input device 395*a* (which in some instances might be a physical button, switch, lever, and/or the like), a microphone 395*b*, and/or a display device 395*c* (which in some cases might be a touchscreen display (which might include touchscreen soft buttons or the like) or a non-touchscreen display, or the like).

In operation, the communications interface 340 might wirelessly communicate with or couple with the communications interface 355 of at least one of the one or more user devices 310 and/or the communications interface 380 of the remote controller 375. The processor 345 of the seat lifter 305' might execute software stored in memory 350 to cause the user interface devices 320 and/or the communications interface 340 to receive user input from a user (in the latter case, from the one or more user devices 310 and/or the remote controller 375), to draw power from the power source 315, to actuate at least one of the one or more first pistons 325*a* and/or the one or more second pistons 325*b* to lift or lower the seat portion 325*c* of the seat lifter 305'. Likewise, the processor 360 of a user device 310 might execute software stored in memory 365 to cause the one or more of user interface devices 370*a*-370*c* to receive user input from the user and to send commands via the communications interface 355 to the seat lifter 305' based on the received user input. Similarly, the processor 385 of the remote controller 375 might execute software stored in memory 390 to cause the one or more of user interface devices 395*a*-395*c* to receive user input from the user and to send commands via the communications interface 380 to the seat lifter 305' based on the received user input. In some embodiments, the heights of the seat portion 325*c* may be set and stored in memory 350 (and/or memory 365 or memory 390) by each of one or more users.

Turning to FIG. 3C, a seat lifter 305" might comprise a power source 315, one or more user interface devices 320, one or more first pistons 325*a*, one or more second pistons 325*b*, and one or more third pistons 330*a*. In some instances, the power source 315 might be one or more of a power supply that plugs into a wall socket; a non-chargeable, replaceable battery; or a power outlet rechargeable battery; or the like. The one or more user interface devices 320, in some embodiments, might include, without limitation, at least one of a user input device 320*a* (which in some instances might be a physical button, switch, lever, and/or the like), a microphone 320*b*, and/or a display device 320*c* (which in some cases might be a touchscreen display or a non-touchscreen display, or the like). The one or more first pistons 325*a* and/or the one or more second pistons 325*b* might be mechanically coupled to a seat portion 325*c* of the seat lifter 305". In some cases, as shown with respect to FIGS. 1 and 2, the one or more first pistons 325*a*, when actuated, might cause a rear portion of the seat portion 325*c* to lift or lower with respect to a seat to which the seat lifter is affixed, while the one or more second pistons 325*b*, when actuated, might cause a front portion of the seat portion 325*c* to lift or lower with respect to the seat to which the seat lifter is affixed. The one or more third pistons 330*a* might be mechanically coupled to a foot rest portion 330*b* of a foot lifter (which might correspond to foot lifter 155 of FIGS. 1E-1I, or the like) of the seat lifter 305". In some instances, as shown with respect to FIGS. 1E-1I, the one or more third pistons 330*a*, when actuated, might cause the foot rest portion 330*b* to lift or lower with respect to a base portion of the seat lifter (or with respect to the floor).

Referring to FIG. 3D, which depicts an alternative embodiment 300'" of a seat lifter 305'", which comprises a power source 315, one or more user interface devices 320, one or more first pistons 325*a*, one or more second pistons 325*b*, a seat portion 325*c*, one or more third pistons 330*a*, a foot rest portion 330*b*, a communications interface 340, at least one processor 345, and a memory 350 (e.g., a non-transitory computer readable medium or the like). In some instances, as in embodiment 300" of FIG. 3C, the power source 315 might be one or more of a power supply that plugs into a wall socket; a non-chargeable, replaceable battery; or a power outlet rechargeable battery; or the like. The one or more user interface devices 320, in some embodiments, might include, without limitation, at least one of a user input device 320*a* (which in some instances might be a physical button, switch, lever, and/or the like), a microphone 320*b*, and/or a display device 320*c* (which in some cases might be a touchscreen display or a non-touchscreen display, or the like). The one or more first pistons 325*a* and/or the one or more second pistons 325*b* might be mechanically coupled to the seat portion 325*c* of the seat lifter 305'". In some cases, as shown with respect to FIGS. 1 and 2, the one or more first pistons 325*a*, when actuated, might cause a rear portion of the seat portion 325*c* to lift or lower with respect to a seat to which the seat lifter is affixed, while the one or more second pistons 325*b*, when actuated, might cause a front portion of the seat portion 325*c* to lift or lower with respect to the seat to which the seat lifter is affixed. The one or more third pistons 330*a* might be mechanically coupled to the foot rest portion 330*b* of a foot lifter (which might correspond to foot lifter 155 of FIGS. 1E-1I, or the like) of the seat lifter 305'''. In some instances, as shown with respect to FIGS. 1E-1I, the one or more third pistons 330*a*, when actuated, might cause the foot rest portion 330*b* to lift or lower with respect to a base portion of the seat lifter (or with respect to the floor).

The one or more user devices 310, in some embodiments, might include, without limitation, a tablet computer 310*a*, a smart phone 310*b*, a mobile phone 310*c*, a personal digital assistant 310*d*, an electronic medical aid device 310*e*, or a laptop computer 310*f*, and/or the like. Each user device 310 might comprise components including, but not limited to, a communications interface 355, at least one processor 360, a memory 365 (e.g., a non-transitory computer readable medium or the like), and one or more user interface devices 370, and/or the like (such as a power source (not shown) or other components of particular user devices). The one or more user interface devices 370, in some embodiments, might include, without limitation, at least one of a user input device 370*a* (which in some instances might be a physical button, switch, lever, and/or the like), a microphone 370*b*, and/or a display device 370*c* (which in some cases might be a touchscreen display (which might include touchscreen soft buttons or the like) or a non-touchscreen display, or the like).

The remote controller 375, according to some embodiments, might include, without limitation, a communications interface 380, a processor 385, a memory 390, and one or more user interface devices 395, and/or the like (such as a power source (not shown) or other components of particular remote controllers). The one or more user interface devices 395, in some embodiments, might include, without limitation, at least one of a user input device 395*a* (which in some instances might be a physical button, switch, lever, and/or the like), a microphone 395*b*, and/or a display device 395*c* (which in some cases might be a touchscreen display (which might include touchscreen soft buttons or the like) or a non-touchscreen display, or the like).

In operation, the communications interface 340 might wirelessly communicate with or couple with the communications interface 355 of at least one of the one or more user devices 310 and/or the communications interface 380 of the remote controller 375. The processor 345 of the seat lifter 305''' might execute software stored in memory 350 to cause the user interface devices 320 and/or the communications interface 340 to receive user input from a user (in the latter case, from the one or more user devices 310 and/or the remote controller 375), to draw power from the power source 315, to actuate at least one of the one or more first pistons 325*a* and/or the one or more second pistons 325*b* to lift or lower the seat portion 325*c* of the seat lifter 305''', and/or to actuate the one or more third pistons 330*a* to lift or lower the foot rest portion 330*b* of the foot lifter of the seat lifter 305'''. Likewise, the processor 360 of a user device 310 might execute software stored in memory 365 to cause the one or more of user interface devices 370*a*-370*c* to receive user input from the user and to send commands via the communications interface 355 to the seat lifter 305''' based on the received user input. Similarly, the processor 385 of the remote controller 375 might execute software stored in memory 390 to cause the one or more of user interface devices 395*a*-395*c* to receive user input from the user and to send commands via the communications interface 380 to the seat lifter 305''' based on the received user input. In some embodiments, the heights of the seat portion 325*c* and/or the foot rest portion 330*b* may be set and stored in memory 350 (and/or memory 365 or memory 390) by each of one or more users.

Figure 4:
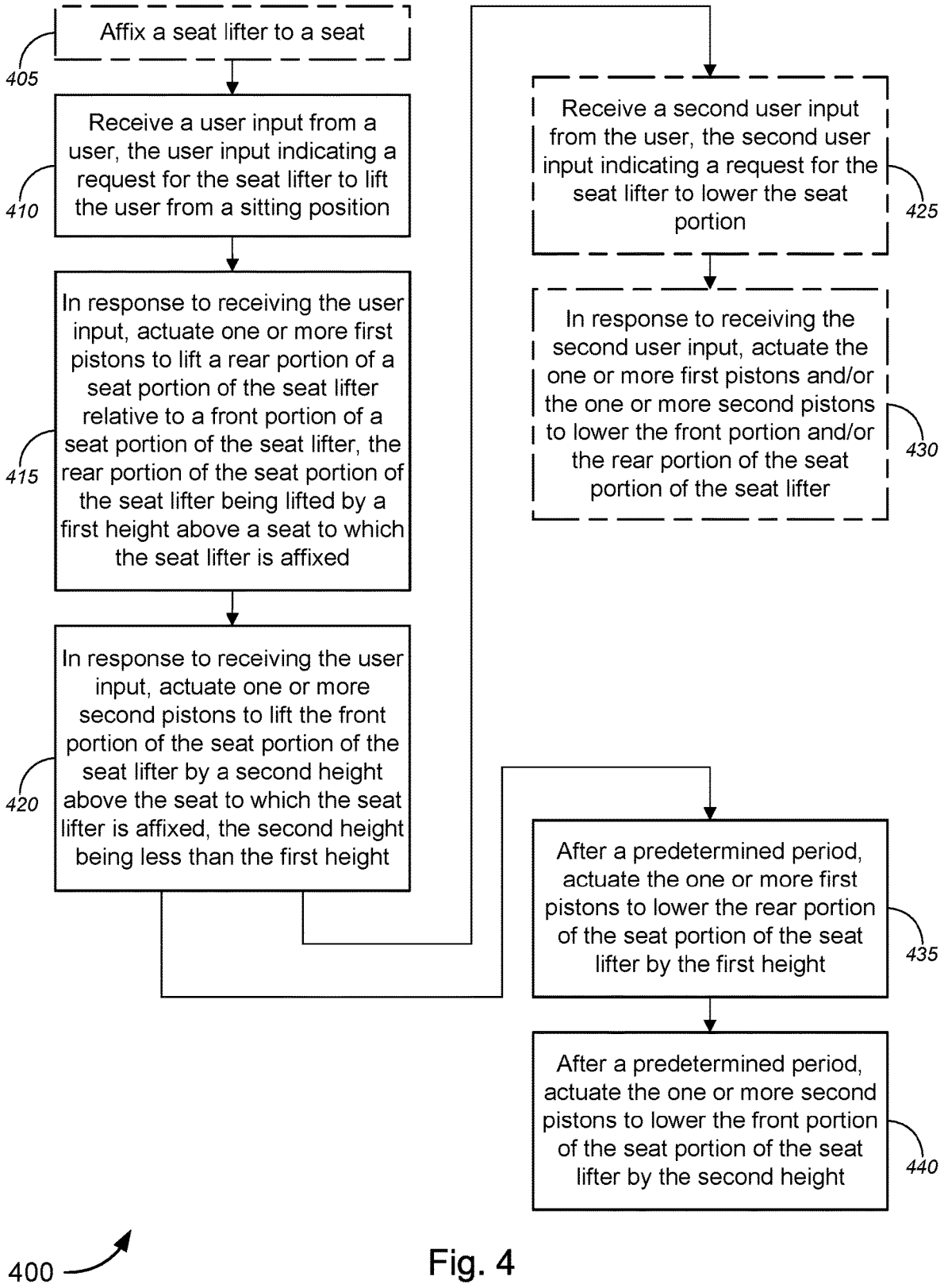
FIG. 4 is a system flow diagram illustrating a method for implementing seat lifting for lifting a person from a sitting position, in accordance with various embodiments.

FIG. 4 is a system flow diagram illustrating a method 400 for implementing seat lifting for lifting a person from a sitting position, in accordance with various embodiments. While the techniques and procedures of the method 400 is depicted and/or described in a certain order for purposes of illustration, it should be appreciated that certain procedures may be reordered and/or omitted within the scope of various embodiments. Moreover, while the method illustrated by FIG. 4 can be implemented by (and, in some cases, are described below with respect to) apparatus or system 100 of FIG. 1 (or components thereof), apparatus or system 200 of FIG. 2 (or components thereof), apparatus or system 300 of FIG. 3 (or components thereof), the method may also be implemented using any suitable hardware implementation. Similarly, while apparatus or system 100 (and/or components thereof), apparatus or system 200 of FIG. 2 (or components thereof), apparatus or system 300 of FIG. 3 (or components thereof), and/or the like can operate according to the method illustrated by FIG. 4 (e.g., by executing instructions embodied on a computer readable medium), apparatuses or systems 100, 200, and/or 300 can also operate according to other modes of operation and/or perform other suitable procedures.

In FIG. 4, method 400 might comprise, at optional block 405, affixing a seat lifter (e.g., seat lifter 105 of FIG. 1, seat lifter 205 of FIG. 2, seat lifter 305 or 305' of FIG. 3, or the like) to a seat (e.g., toilet 110 of FIG. 1, lounge chair 210 of FIG. 2, other chair, including, but not limited to rocking chairs, reclining chairs, love seats, couches, benches, stools, office chairs, desk chairs, and/or the like). In alternative embodiments, the seat lifter and the seat might be built or constructed as a unitary piece of furniture or the like.

At block 410, method 400 might comprise receiving a user input from a user, the user input indicating a request for the seat lifter to lift the user from a sitting position. In some embodiments, receiving the user input from the user might comprise receiving the user input from the user via at least one of a physical button, a touchscreen soft button, or a microphone on the seat lifter. Alternatively or additionally, receiving the user input from the user might comprise receiving the user input from the user via at least one of a physical button, a touchscreen soft button, or a microphone on a remote controller (e.g., remote controller 375 of FIG. 3, or the like) for the seat lifter. Alternatively or additionally, receiving the user input from the user might comprise receiving the user input from the user via at least one of a physical button, a touchscreen soft button, or a microphone on a user device associated with the user (e.g., user device 310 of FIG. 3, or the like).

Method 400 might further comprise, in response to receiving the user input, actuating one or more first pistons to lift a rear portion of a seat portion of the seat lifter relative to a front portion of a seat portion of the seat lifter (as shown, for example, in FIG. 1C, 1D, 2C, or 2D), the rear portion of the seat portion of the seat lifter being lifted by a first height (e.g., height $h_1$ of FIG. 1D or height $h_4$ of FIG. 2D, or the like) above a seat to which the seat lifter is affixed (block 415). According to some embodiments (although not necessarily all embodiments), method 400, at block 420, might comprise in response to receiving the user input, actuating one or more second pistons to lift the front portion of the seat portion of the seat lifter by a second height (e.g., height $h_2$ of FIG. 1D or height $h_5$ of FIG. 2D, or the like) above the seat to which the seat lifter is affixed (as shown, for example, in FIG. 1D or 2D), the second height being less than the first height. In some instances, the processes at blocks 415 and 420 might be performed serially one after the other (in either order), or might be performed concurrently.

In embodiments in which a user provides a second user input to indicate a request for the seat lifter to lower the seat portion, method 400 might further comprise receiving the second user input from the user (optional block 425) and, in response to receiving the second user input, actuating the one or more first pistons and/or the one or more second pistons to lower the front portion and/or the rear portion, respectively, of the seat portion of the seat lifter (optional block 430).

Alternatively or additionally, after a predetermined period of time (including, but not limited to 30 s, 1 minute, 2 minutes, 3 minutes, 5 minutes, etc.) after the seat portion has been lifted (at block 415 and/or block 420), method 400 might further comprise actuating the one or more first pistons to lower the rear portion of the seat portion of the seat lifter by the first height (block 435) and/or actuating the one or more second pistons to lower the front portion of the seat portion of the seat lifter by the second height (block 440). In some instances, the processes at blocks 435 and 440 might be performed serially one after the other (in either order), or might be performed concurrently.

Although not shown in FIG. 4, in embodiments in which the seat is a toilet, the method might further comprise (prior to the process at block 410) receiving user input from the user indicating a request for the seat lifter to lift a foot rest portion of a foot lifter (such as foot lifter 155 of FIGS. 1E-1I, or the like) to lift the feet of the user relative to the floor or relative to the base portion of the seat lifter, so as to orient the user into a squatted position to facilitate bowel movement. In response to receiving such user input, the method might comprise actuating one or more third pistons to the lift the foot rest portion (on which the user's feet rest) to a third height relative to the floor or relative to the base portion of the seat lifter. In some embodiments, the method might comprise receiving further user input to tilt back the foot rest portion (in a manner as shown and described above with respect to FIG. 1H). The method might further comprise receiving user input from the user indicating a request for the seat lifter to lower the foot rest portion. In response to receiving such user input, the method might comprise actuating the one or more third pistons to lower the foot rest portion.

Figure 5:
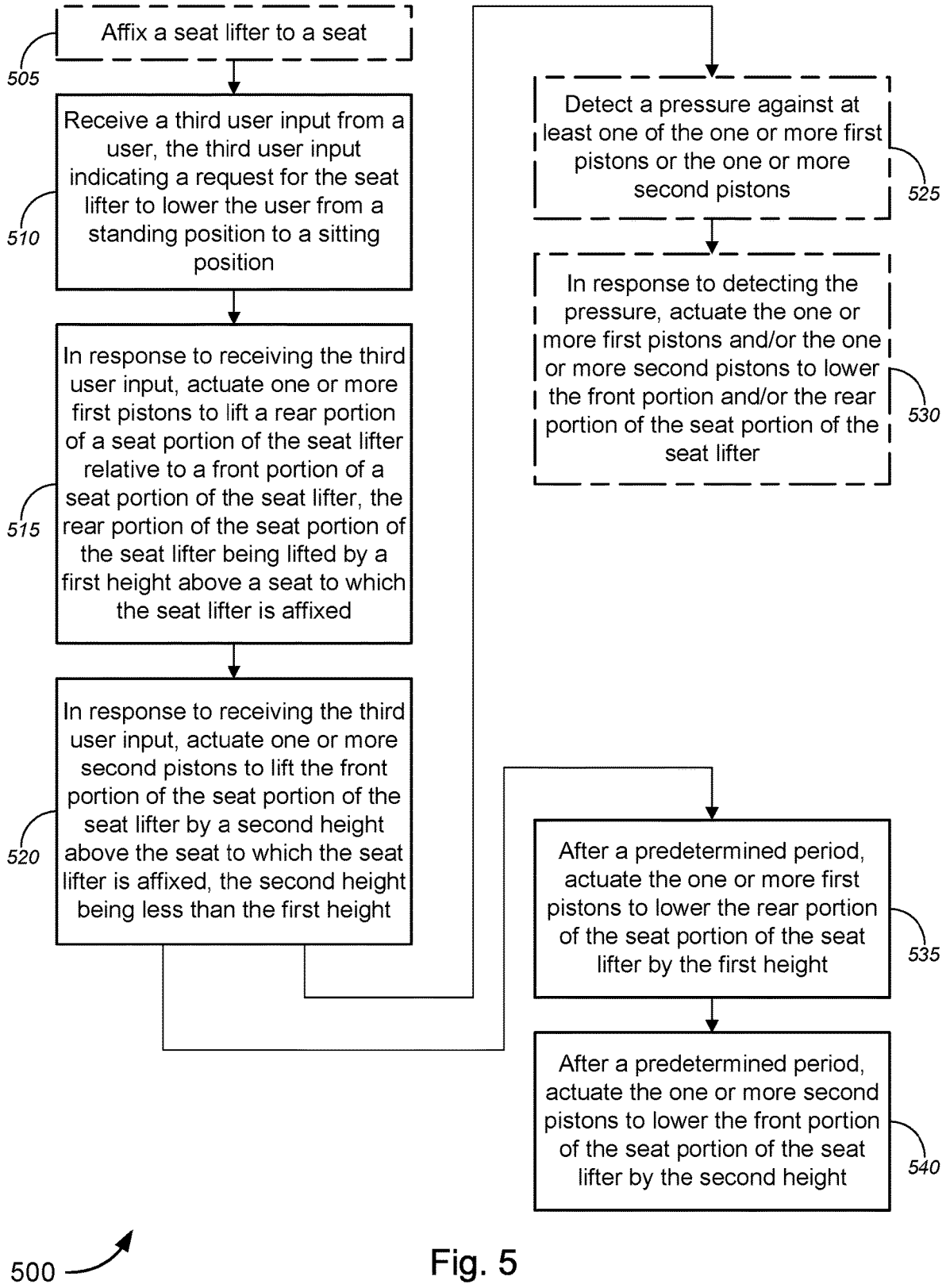
FIG. 5 is a system flow diagram illustrating a method for implementing seat lifting for lowering a person from a standing position to a sitting position, in accordance with various embodiments.

FIG. 5 is a system flow diagram illustrating a method 500 for implementing seat lifting for lowering a person from a standing position to a sitting position, in accordance with various embodiments. While the techniques and procedures of the method 500 is depicted and/or described in a certain order for purposes of illustration, it should be appreciated that certain procedures may be reordered and/or omitted within the scope of various embodiments. Moreover, while the method illustrated by FIG. 5 can be implemented by (and, in some cases, are described below with respect to) apparatus or system 100 of FIG. 1 (or components thereof), apparatus or system 200 of FIG. 2 (or components thereof), apparatus or system 300 of FIG. 3 (or components thereof), the method may also be implemented using any suitable hardware implementation. Similarly, while apparatus or system 100 (and/or components thereof), apparatus or system 200 of FIG. 2 (or components thereof), apparatus or system 300 of FIG. 3 (or components thereof), and/or the like can operate according to the method illustrated by FIG. 5 (e.g., by executing instructions embodied on a computer readable medium), apparatuses or systems 100, 200, and/or 300 can also operate according to other modes of operation and/or perform other suitable procedures.

In FIG. 5, method 500 might comprise, at optional block 505, affixing a seat lifter (e.g., seat lifter 105 of FIG. 1, seat lifter 205 of FIG. 2, seat lifter 305 or 305' of FIG. 3, or the like) to a seat (e.g., toilet 110 of FIG. 1, lounge chair 210 of FIG. 2, other chair, including, but not limited to rocking chairs, reclining chairs, love seats, couches, benches, stools, office chairs, desk chairs, and/or the like). In alternative embodiments, the seat lifter and the seat might be built or constructed as a unitary piece of furniture or the like.

At block 510, method 500 might comprise receiving a third user input from a user, the third user input indicating a request for the seat lifter to lower the user from a standing position to a sitting position. In some embodiments, receiving the third user input from the user might comprise receiving the third user input from the user via at least one of a physical button, a touchscreen soft button, or a microphone on the seat lifter. Alternatively or additionally, receiving the third user input from the user might comprise receiving the third user input from the user via at least one of a physical button, a touchscreen soft button, or a microphone on a remote controller (e.g., remote controller 375 of FIG. 3, or the like) for the seat lifter. Alternatively or additionally, receiving the third user input from the user might comprise receiving the third user input from the user via at least one of a physical button, a touchscreen soft button, or a microphone on a user device associated with the user (e.g., user device 310 of FIG. 3, or the like).

Method 500 might further comprise, in response to receiving the third user input, actuating one or more first pistons to lift a rear portion of a seat portion of the seat lifter relative to a front portion of a seat portion of the seat lifter (as shown, for example, in FIG. 1C, 1D, 2C, or 2D), the rear portion of the seat portion of the seat lifter being lifted by a first height (e.g., height $h_1$ of FIG. 1D or height $h_4$ of FIG. 2D, or the like) above a seat to which the seat lifter is affixed (block 515). According to some embodiments (although not necessarily all embodiments), method 500, at block 520, might comprise in response to receiving the third user input, actuating one or more second pistons to lift the front portion of the seat portion of the seat lifter by a second height (e.g., height $h_2$ of FIG. 1D or height $h_5$ of FIG. 2D, or the like) above the seat to which the seat lifter is affixed (as shown, for example, in FIG. 1D or 2D), the second height being less than the first height. In some instances, the processes at blocks 515 and 520 might be performed serially one after the other (in either order), or might be performed concurrently.

In embodiments in which a pressure or weight sensor is implemented, such as, for example, as part of the at least one of the one or more first pistons and/or the one or more second pistons, method 500 might further comprise detecting a pressure (or weight) against at least one of the one or more first pistons or the one or more second pistons (optional block 525) and, in response to detecting the pressure, actuating the one or more first pistons and/or the one or more second pistons to lower the front portion and/or the rear portion, respectively, of the seat portion of the seat lifter (optional block 530), thereby lowering the user from the standing position to a sitting position.

Alternatively or additionally, after a predetermined period of time (including, but not limited to 30 s, 1 minute, 2 minutes, 3 minutes, 5 minutes, etc.) after the seat portion has been lifted (at block 515 and/or block 520), method 500 might further comprise actuating the one or more first pistons to lower the rear portion of the seat portion of the seat lifter by the first height (block 535) and/or actuating the one or more second pistons to lower the front portion of the seat portion of the seat lifter by the second height (block 540), thereby lowering the user from the standing position to a sitting position. In some instances, the processes at blocks 535 and 540 might be performed serially one after the other (in either order), or might be performed concurrently.

In embodiments in which a user provides a fourth user input to indicate a request for the seat lifter to lower the seat portion (not shown, but similar to optional blocks 425 and 430 of FIG. 4), method 500 might further comprise receiving the fourth user input from the user and, in response to receiving the fourth user input, actuating the one or more first pistons and/or the one or more second pistons to lower the front portion and/or the rear portion, respectively, of the seat portion of the seat lifter, thereby lowering the user from the standing position to a sitting position.

Although not shown in FIG. 5, in embodiments in which the seat is a toilet, the method might further comprise (after the process at block 530 or block 540) receiving user input from the user indicating a request for the seat lifter to lift a foot rest portion of a foot lifter (such as foot lifter 155 of FIGS. 1E-1I, or the like) to lift the feet of the user relative to the floor or relative to the base portion of the seat lifter, so as to orient the user into a squatted position to facilitate bowel movement. In response to receiving such user input, the method might comprise actuating one or more third pistons to the lift the foot rest portion (on which the user's feet rest) to a third height relative to the floor or relative to the base portion of the seat lifter. In some embodiments, the method might comprise receiving further user input to tilt back the foot rest portion (in a manner as shown and described above with respect to FIG. 1H). The method might further comprise receiving user input from the user indicating a request for the seat lifter to lower the foot rest portion. In response to receiving such user input, the method might comprise actuating the one or more third pistons to lower the foot rest portion.

Exemplary System and Hardware Implementation

Figure 6:
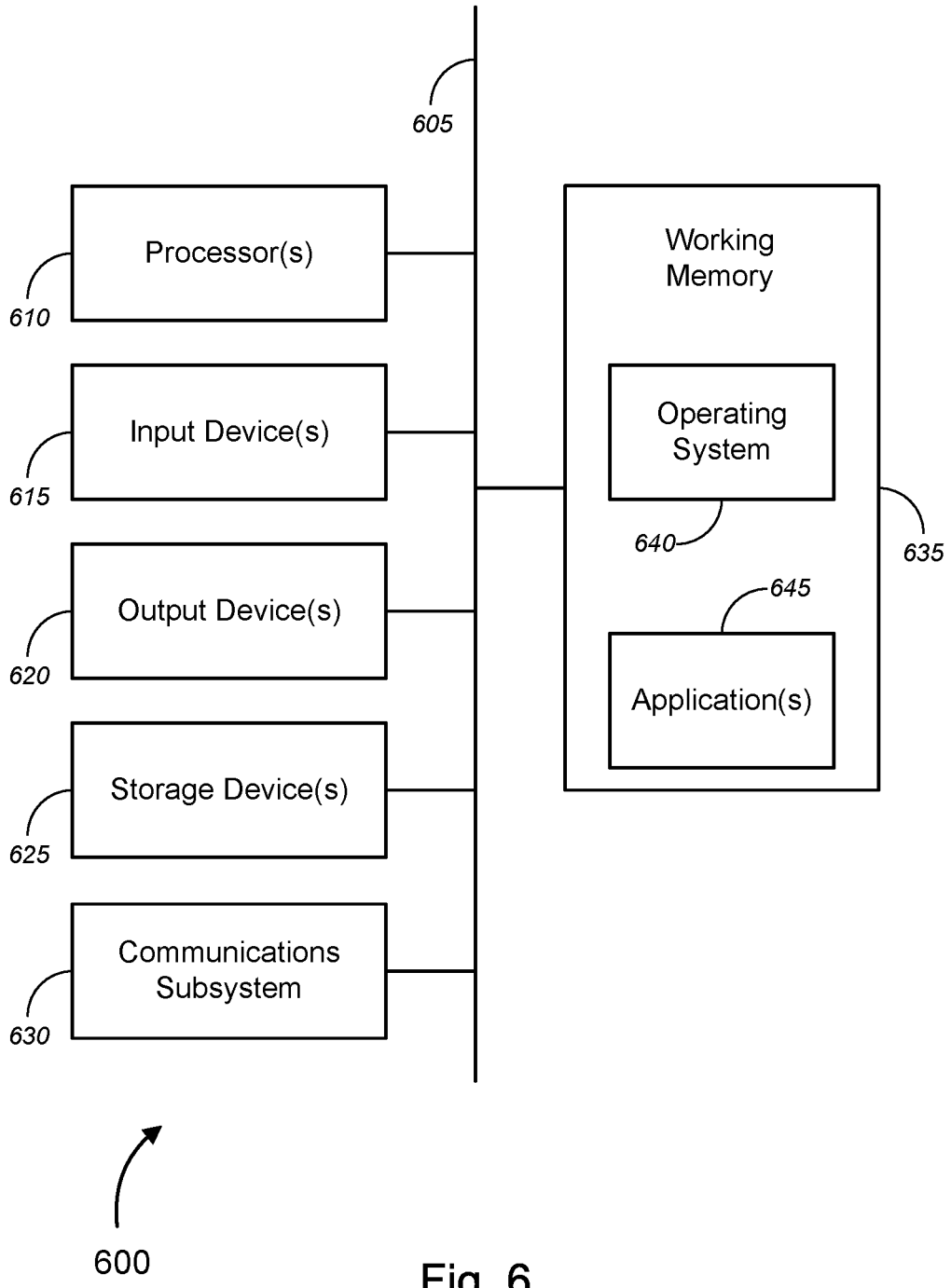
FIG. 6 is a block diagram illustrating an exemplary computer or system hardware architecture, in accordance with various embodiments.

FIG. 6 is a block diagram illustrating an exemplary computer or system hardware architecture, in accordance with various embodiments. FIG. 6 provides a schematic illustration of one embodiment of a computer system 600 of the service provider system hardware that can perform the methods provided by various other embodiments, as described herein, and/or can perform the functions of computer or hardware system (i.e., seat lifter 305', user device(s) 310, remote controller 375, and/or the like, as described above). It should be noted that FIG. 6 is meant only to provide a generalized illustration of various components, of which one or more (or none) of each may be utilized as appropriate. FIG. 6, therefore, broadly illustrates how individual system elements may be implemented in a relatively separated or relatively more integrated manner.

The computer or hardware system 600—which might represent an embodiment of the computer or hardware system (i.e., seat lifter 305', user device(s) 310, remote controller 375, and/or the like, as described above with respect to FIGS. 1-5)—is shown comprising hardware elements that can be electrically coupled via a bus 605 (or may otherwise be in communication, as appropriate). The hardware elements may include one or more processors 610, including, without limitation, one or more general-purpose processors and/or one or more special-purpose processors (such as digital signal processing chips, graphics acceleration processors, and/or the like); one or more input devices 615, which can include, without limitation, a mouse, a keyboard and/or the like; and one or more output devices 620, which can include, without limitation, a display device, a printer, and/or the like.

The computer or hardware system 600 may further include (and/or be in communication with) one or more storage devices 625, which can comprise, without limitation, local and/or network accessible storage, and/or can include, without limitation, a disk drive, a drive array, an optical storage device, solid-state storage device such as a random access memory ("RAM") and/or a read-only memory ("ROM"), which can be programmable, flash-updateable and/or the like. Such storage devices may be configured to implement any appropriate data stores, including, without limitation, various file systems, database structures, and/or the like.

The computer or hardware system 600 might also include a communications subsystem 630, which can include, without limitation, a modem, a network card (wireless or wired), an infra-red communication device, a wireless communication device and/or chipset (such as a Bluetooth™ device, an 802.11 device, a WiFi device, a WiMax device, a WWAN device, cellular communication facilities, etc.), and/or the like. The communications subsystem 630 may permit data to be exchanged with a network (such as the network described below, to name one example), with other computer or hardware systems, and/or with any other devices described herein. In many embodiments, the computer or hardware system 600 will further comprise a working memory 635, which can include a RAM or ROM device, as described above.

The computer or hardware system 600 also may comprise software elements, shown as being currently located within the working memory 635, including an operating system 640, device drivers, executable libraries, and/or other code, such as one or more application programs 645, which may comprise computer programs provided by various embodiments (including, without limitation, hypervisors, VMs, and the like), and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be encoded and/or stored on a non-transitory computer readable storage medium, such as the storage device(s) 625 described above. In some cases, the storage medium might be incorporated within a computer system, such as the system 600. In other embodiments, the storage medium might be separate from a computer system (i.e., a removable medium, such as a compact disc, etc.), and/or provided in an installation package, such that the storage medium can be used to program, configure and/or adapt a general purpose computer with the instructions/code stored thereon. These instructions might take the form of executable code, which is executable by the computer or hardware system 600 and/or might take the form of source and/or installable code, which, upon compilation and/or installation on the computer or hardware system 600 (e.g., using any of a variety of generally available compilers, installation programs, compression/decompression utilities, etc.) then takes the form of executable code.

It will be apparent to those skilled in the art that substantial variations may be made in accordance with specific requirements. For example, customized hardware (such as programmable logic controllers, field-programmable gate arrays, application-specific integrated circuits, and/or the like) might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer or hardware system (such as the computer or hardware system 600) to perform methods in accordance with various embodiments of the invention. According to a set of embodiments, some or all of the procedures of such methods are performed by the computer or hardware system 600 in response to processor 610 executing one or more sequences of one or more instructions (which might be incorporated into the operating system 640 and/or other code, such as an application program 645) contained in the working memory 635. Such instructions may be read into the working memory 635 from another computer readable medium, such as one or more of the storage device(s) 625. Merely by way of example, execution of the sequences of instructions contained in the working memory 635 might cause the processor(s) 610 to perform one or more procedures of the methods described herein.

The terms "machine readable medium" and "computer readable medium," as used herein, refer to any medium that participates in providing data that causes a machine to operate in a specific fashion. In an embodiment implemented using the computer or hardware system 600, various computer readable media might be involved in providing instructions/code to processor(s) 610 for execution and/or might be used to store and/or carry such instructions/code (e.g., as signals). In many implementations, a computer readable medium is a non-transitory, physical, and/or tangible storage medium. In some embodiments, a computer readable medium may take many forms, including, but not limited to, non-volatile media, volatile media, or the like. Non-volatile media includes, for example, optical and/or magnetic disks, such as the storage device(s) 625. Volatile media includes, without limitation, dynamic memory, such as the working memory 635. In some alternative embodiments, a computer readable medium may take the form of transmission media, which includes, without limitation, coaxial cables, copper wire and fiber optics, including the wires that comprise the bus 605, as well as the various components of the communication subsystem 630 (and/or the media by which the communications subsystem 630 provides communication with other devices). In an alternative set of embodiments, transmission media can also take the form of waves (including without limitation radio, acoustic and/or light waves, such as those generated during radio-wave and infra-red data communications).

Common forms of physical and/or tangible computer readable media include, for example, a floppy disk, a flexible disk, a hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read instructions and/or code.

Various forms of computer readable media may be involved in carrying one or more sequences of one or more instructions to the processor(s) 610 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer or hardware system 600. These signals, which might be in the form of electromagnetic signals, acoustic signals, optical signals, and/or the like, are all examples of carrier waves on which instructions can be encoded, in accordance with various embodiments of the invention.

The communications subsystem 630 (and/or components thereof) generally will receive the signals, and the bus 605 then might carry the signals (and/or the data, instructions, etc. carried by the signals) to the working memory 635, from which the processor(s) 605 retrieves and executes the instructions. The instructions received by the working memory 635 may optionally be stored on a storage device 625 either before or after execution by the processor(s) 610.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A seat lifter, comprising:

a seat portion, the seat portion comprising a front portion, a rear portion, one or more first connection points integrated into the rear portion, and one or more second connection points integrated into the front portion;

a foot rest portion comprising a semi-circular cut-out configured to prevent the foot rest portion from contacting the seat portion;

an input device that receives a first user input from a user and a second user input from the user, the first user input indicating a first request for the seat lifter to lift the user from a sitting position and the second user input indicating a second request indicating a request to lift the foot rest portion to an elevated position;

one or more first pistons coupled to the one or more first connection points integrated into the rear portion of the seat portion, the one or more first pistons, when actuated in response to receiving the first user input, causing the rear portion of the seat portion of the seat lifter to lift relative to the front portion of the seat portion of the seat lifter, the rear portion of the seat portion of the seat lifter being lifted by a first height above a seat to which the seat lifter is affixed;

one or more second pistons coupled to the one or more second connection points integrated into the front portion of the seat portion, the one or more second pistons, when actuated in response to receiving the first user input, causing the front portion of the seat portion of the seat lifter to lift by a second height above the seat to which the seat lifter is affixed, the second height being less than the first height, wherein the one or more second pistons, when actuated, lift the front portion of the seat lifter independently from the rear portion of the seat lifter being lifted by the one or more first pistons, when actuated; and at least one of a pressure sensor or a weight sensor integrated with at least one of the one or more first pistons or the one or more second pistons and configured to detect at least one of a pressure or weight and in response to detecting at least one of the pressure or the weight, at least one of the one or more first pistons or the one or more second pistons actuate to lower at least one of the front portion of the seat portion of the seat lifter or the rear portion of the seat portion of the seat lifter;

one or more third pistons coupled to the foot rest portion, the one or more third pistons, when actuated in response to receiving the second user input, lift a rear portion of the foot rest portion to a third height relative to a floor surface; and one or more fourth pistons coupled to the foot rest portion, the one or more fourth pistons, when actuated in response to receiving the second user input, lift a front portion of the foot rest portion by a fourth height relative to the floor surface, the fourth height relative to the floor surface being more than the third height relative to the floor surface.

2. The seat lifter of claim 1, further comprising:

at least one processor;

a non-transitory computer readable medium communicatively coupled to the at least one processor, the non-transitory computer readable medium having stored thereon computer software comprising a set of instructions that, when executed by the at least one processor, causes the seat lifter to:

in response to receiving the first user input, actuate the one or more first pistons to lift the rear portion of the seat portion of the seat lifter relative to the front portion of the seat portion of the seat lifter.

3. The seat lifter of claim 1, wherein, after a predetermined period, the one or more first pistons are actuated to lower the rear portion of the seat portion of the seat lifter by the first height.

4. The seat lifter of claim 1, wherein, after a predetermined period, the one or more second pistons are actuated to lower the front portion of the seat portion of the seat lifter by the second height.

5. The seat lifter of claim 1, wherein the input device comprises at least one of a physical button, a touchscreen soft button, or a microphone on the seat lifter.

6. The seat lifter of claim 1, wherein the input device comprises a transceiver that communicatively couples to a remote controller, the remote controller comprising at least one of a physical button, a touchscreen soft button, or a microphone.

7. The seat lifter of claim 1, wherein the input device comprises a transceiver that communicatively couples to a user device associated with the user, the user device comprising at least one of a physical button, a touchscreen soft button, or a microphone.

8. The seat lifter of claim 1, wherein the seat to which the seat lifter is affixed comprises one of a toilet fixture or a toilet seat.

9. The seat lifter of claim 1, wherein the seat to which the seat lifter is affixed comprises one of a lounge chair, a rocking chair, a reclining chair, a love seat, a couch, a bench, a stool, an office chair, or a desk chair.

10. The seat lifter of claim 1, wherein the seat to which the seat lifter is affixed and the seat lifter are separable components that are constructed separately and subsequently affixed together.

11. The seat lifter of claim 1, further comprising:

a base portion, the base portion comprising one or more anchor portions that affix to one or more corresponding portions of the seat to which the seat lifter is affixed.

12. The seat lifter of claim 1, wherein the seat to which the seat lifter is affixed and the seat lifter are integral components that are constructed as unitary piece.

13. A method for implementing seat lifting, comprising:

receiving a first user input from a user, the first user input indicating a first request for a seat lifter to lift the user from a sitting position;

in response to receiving the first user input, actuating one or more first pistons to lift a rear portion of a seat portion of the seat lifter relative to a front portion of the seat portion of the seat lifter, the rear portion of the seat portion of the seat lifter being lifted by a first height above a seat to which the seat lifter is affixed, wherein the seat portion has one or more integrated first connection points to couple the one or more first pistons to the seat portion;

in response to receiving the first user input, actuating one or more second pistons to lift the front portion of the seat portion of the seat lifter by a second height above the seat to which the seat lifter is affixed, the second height being less than the first height, wherein the one or more second pistons, when actuated, lift the front portion of the seat lifter independently from the rear portion of the seat lifter being lifted by the one or more first pistons, when actuated, wherein the seat portion has one or more integrated second connection points to couple the one or more second pistons to the seat portion;

detecting, via at least one of a pressure sensor or a weight sensor integrated with at least one of the one or more first pistons or the one or more second pistons, at least one of a pressure or a weight against at least one of the one or more first pistons or the one or more second pistons;

in response to detecting at least one of the pressure or the weight, actuating at least one of the one or more first pistons or the one or more second pistons to lower at least one of the front portion of the seat portion of the seat lifter or the rear portion of the seat portion of the seat lifter;

receiving a second user input from the user, the second user input indicating a second request to lift a foot rest portion to an elevated position; and in response to receiving the second user input, actuating one or more third pistons to lift a rear portion of the foot rest portion to a third height relative to a floor surface and actuating one or more fourth pistons to lift a front portion of the foot rest portion by a fourth height relative to the floor surface, the fourth height relative to the floor surface being more than the third height relative to the floor surface, wherein the foot rest portion comprises a semi-circular cut-out configured to prevent the foot rest portion from contacting the seat portion.

14. The method of claim 13, further comprising:

after a predetermined period, actuating the one or more first pistons to lower the rear portion of the seat portion of the seat lifter by the first height.

15. The method of claim 13, further comprising:

after a predetermined period, actuating the one or more second pistons to lower the front portion of the seat portion of the seat lifter by the second height.

16. The method of claim 13, wherein receiving the first and second user inputs from the user comprises receiving the first and second user inputs from the user via at least one of a physical button, a touchscreen soft button, or a microphone on the seat lifter.

17. The method of claim 13, wherein receiving the first and second user inputs from the user comprises receiving the first and second user inputs from the user via at least one of a physical button, a touchscreen soft button, or a microphone on a remote controller for the seat lifter.

18. The method of claim 13, wherein receiving the first and second user inputs from the user comprises receiving the first and second user inputs from the user via at least one of a physical button, a touchscreen soft button, or a microphone on a user device associated with the user.

19. The method of claim 18, wherein the user device associated with the user comprises at least one of a tablet computer, a smart phone, a mobile phone, a personal digital assistant, an electronic medical aid device, or a laptop computer.

20. The method of claim 13, wherein the seat to which the seat lifter is affixed comprises one of a toilet fixture or a toilet seat.

21. The method of claim 13, wherein the seat to which the seat lifter is affixed comprises one of a lounge chair, a rocking chair, a reclining chair, a love seat, a couch, a bench, a stool, an office chair, or a desk chair.

22. The method of claim 13, further comprising:

in response to receiving the first user input, tilting the seat lifter to cause the front portion of the seat portion to extend past a front edge of a support frame of the seat portion.

23. The method of claim 13, wherein actuating the one or more third pistons to lift the foot rest portion to the elevated position relative to a floor surface causes the foot rest portion to tilt toward or away from the seat portion.

24. The method of claim 13, further comprising:

receiving a third user input to set and store one or more desired positions of the seat portion;

associating the one or more desired positions of the seat portion with the user; and storing the one or more desired positions associated with the user.

25. The method of claim 13, further comprising:

receiving a third user input to set and store one or more desired positions of the foot portion;

associating the one or more desired positions of the foot portion with the user; and storing the one or more desired positions associated with the user.

* * * * *